US009889646B2

(12) United States Patent
Seto et al.

(10) Patent No.: US 9,889,646 B2
(45) Date of Patent: Feb. 13, 2018

(54) DROPLET DRIVING CONTROL DEVICE AND IMAGE FORMING APPARATUS

(71) Applicant: FUJI XEROX CO., LTD., Tokyo (JP)

(72) Inventors: Shinji Seto, Kanagawa (JP); Hirotake Sasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 81 days.

(21) Appl. No.: 15/005,229

(22) Filed: Jan. 25, 2016

(65) Prior Publication Data

US 2017/0001437 A1 Jan. 5, 2017

(30) Foreign Application Priority Data

Jul. 2, 2015 (JP) ..... 2015-133319

(51) Int. Cl.
*B41J 2/045* (2006.01)

(52) U.S. Cl.
CPC ..... *B41J 2/04588* (2013.01); *B41J 2/0459* (2013.01); *B41J 2/04573* (2013.01); *B41J 2/04581* (2013.01); *B41J 2/04593* (2013.01)

(58) Field of Classification Search
CPC .. B41J 2/04581; B41J 2/04588; B41J 2/0459; B41J 2/04593; B41J 2/04573; B41J 2/0458; B41J 2/04563; B41J 2/04528; B41J 2/04578; B41J 2/04591
See application file for complete search history.

(56) References Cited

U.S. PATENT DOCUMENTS

2007/0211092 A1* 9/2007 Shingyohuchi ..... B41J 2/04581 347/10

FOREIGN PATENT DOCUMENTS

| | | |
|---|---|---|
| JP | 7-323550 | 12/1995 |
| JP | 2006-88712 | 4/2006 |
| JP | 2007-22095 | 2/2007 |

OTHER PUBLICATIONS

Abstract and machine translation of JP 2006-88712.
Abstract and machine translation of JP 2007-22095.
Abstract and machine translation of JP 7-323550.

* cited by examiner

*Primary Examiner* — Thinh H Nguyen
(74) *Attorney, Agent, or Firm* — Fildes & Outland, P.C.

(57) ABSTRACT

A droplet driving control device includes: an output unit which outputs, at droplet ejection timing, a driving waveform for ejecting each droplet at a requested droplet ejection period, the waveform being a reference driving waveform including a plurality of pulse signals which can be set ON or OFF individually; a determination unit which determines whether the droplet ejection period has to be changed or not; an adjustment unit which sets each of the pulse signals of the reference driving waveform ON or OFF selectively based on a determination result of the determination unit to adjust the reference driving waveform to an adjusted driving waveform; and a droplet ejection control unit which ejects each droplet by use of the adjusted driving waveform adjusted by the adjustment unit.

16 Claims, 17 Drawing Sheets

(CONT.)

(FIG. 4 CONTINUED)
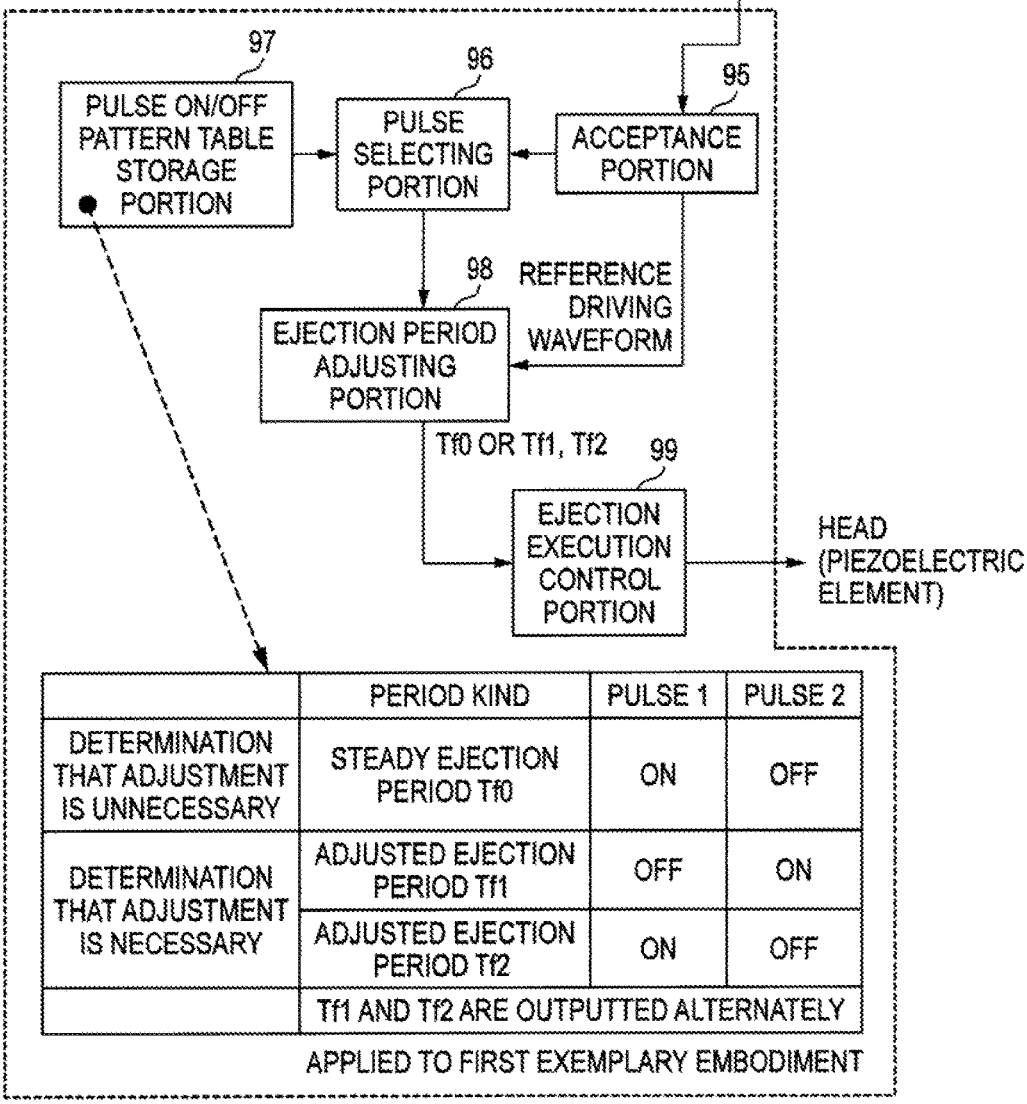
| | PERIOD KIND | PULSE 1 | PULSE 2 |
|---|---|---|---|
| DETERMINATION THAT ADJUSTMENT IS UNNECESSARY | STEADY EJECTION PERIOD Tf0 | ON | OFF |
| DETERMINATION THAT ADJUSTMENT IS NECESSARY | ADJUSTED EJECTION PERIOD Tf1 | OFF | ON |
| | ADJUSTED EJECTION PERIOD Tf2 | ON | OFF |
| | Tf1 AND Tf2 ARE OUTPUTTED ALTERNATELY | | |
APPLIED TO FIRST EXEMPLARY EMBODIMENT

"ADJUSTED DRIVING WAVEFORM"

"STEADY DRIVING WAVEFORM"

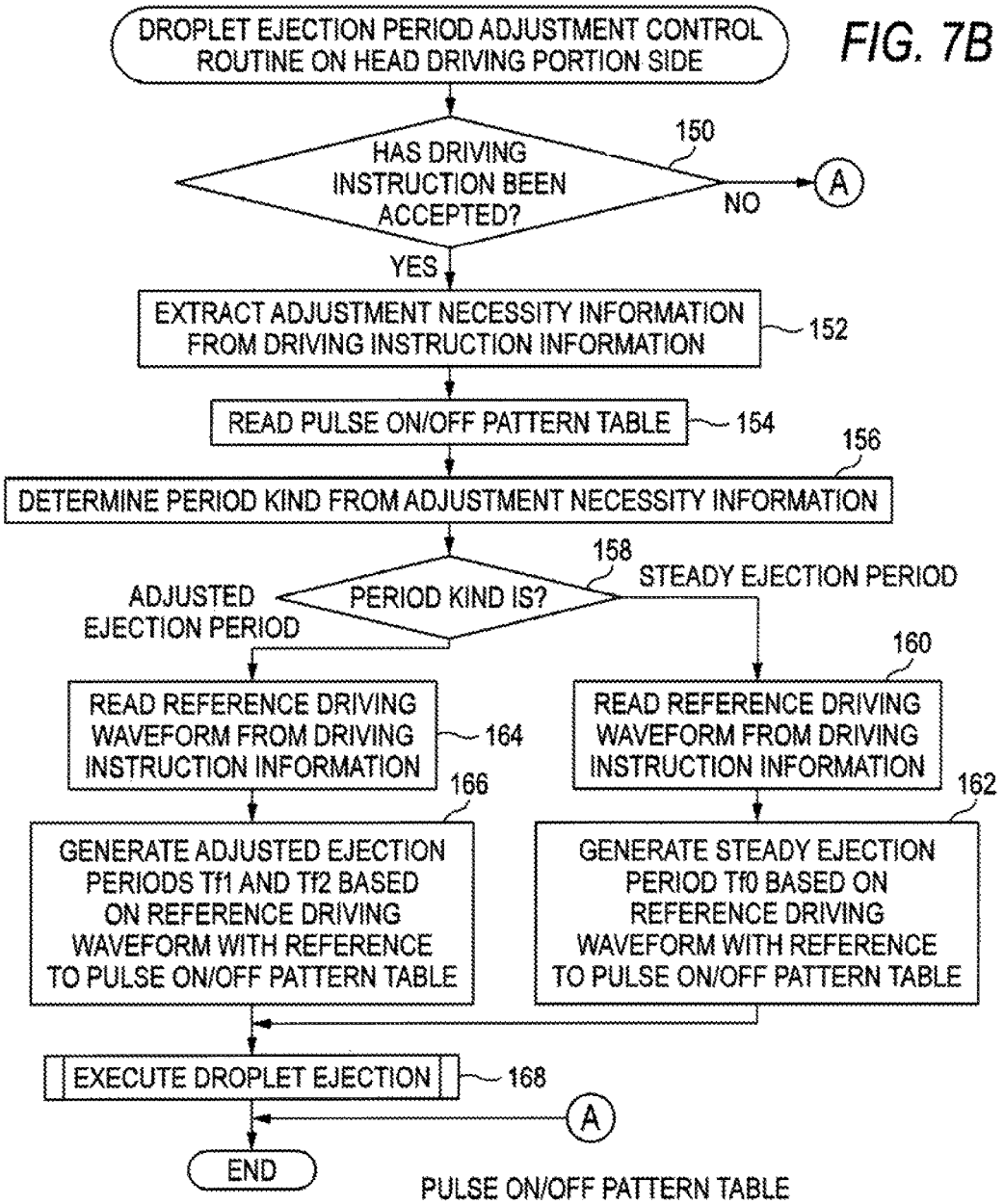
PULSE ON/OFF PATTERN TABLE
| | PERIOD KIND | PULSE 1 | PULSE 2 |
|---|---|---|---|
| DETERMINATION THAT ADJUSTMENT IS UNNECESSARY | STEADY EJECTION PERIOD Tf0 | ON | OFF |
| DETERMINATION THAT ADJUSTMENT IS NECESSARY | ADJUSTED EJECTION PERIOD Tf1 | OFF | ON |
| | ADJUSTED EJECTION PERIOD Tf2 | ON | OFF |
| | Tf1 AND Tf2 ARE OUTPUTTED ALTERNATELY | | |

"STEADY DRIVING WAVEFORM"

"ADJUSTED DRIVING WAVEFORM"

"STEADY DRIVING WAVEFORM"

"ADJUSTED DRIVING WAVEFORM"

"STEADY DRIVING WAVEFORM"

DROPLET DRIVING CONTROL DEVICE AND IMAGE FORMING APPARATUS

CROSS-REFERENCE TO RELATED APPLICATIONS

This application is based on and claims priority under 35 USC 119 from Japanese Patent Application No. 2015-133319 filed on Jul. 2, 2015.

BACKGROUND

1. Technical Field

The present invention relates to a droplet driving control device and an image forming apparatus.

2. Related Art

In an apparatus which ejects droplets of ink etc. to form an image, such as an inkjet continuous feed printer, a driving frequency for controlling timing of droplet ejection is set in accordance with image formation speed.

SUMMARY

According to an aspect of the invention, there is provided a droplet driving control device comprising: an output unit which outputs, at droplet ejection timing, a driving waveform for ejecting each droplet at a requested droplet ejection period, the waveform being a reference driving waveform including a plurality of pulse signals which can be set ON or OFF individually; a determination unit which determines whether the droplet ejection period has to be changed or not; an adjustment unit which sets each of the pulse signals of the reference driving waveform ON or OFF selectively based on a determination result of the determination unit to adjust the reference driving waveform to an adjusted driving waveform; and a droplet ejection control unit which ejects each droplet by use of the adjusted driving waveform adjusted by the adjustment unit.

BRIEF DESCRIPTION OF THE DRAWINGS

Exemplary embodiments of the present invention will be described in detail based on the following figures, wherein:

FIGS. 7A and 7B are flow charts showing the flows of droplet ejection period adjustment control routines according to the first exemplary embodiment;

REFERENCE SIGNS LIST

Figure 1:
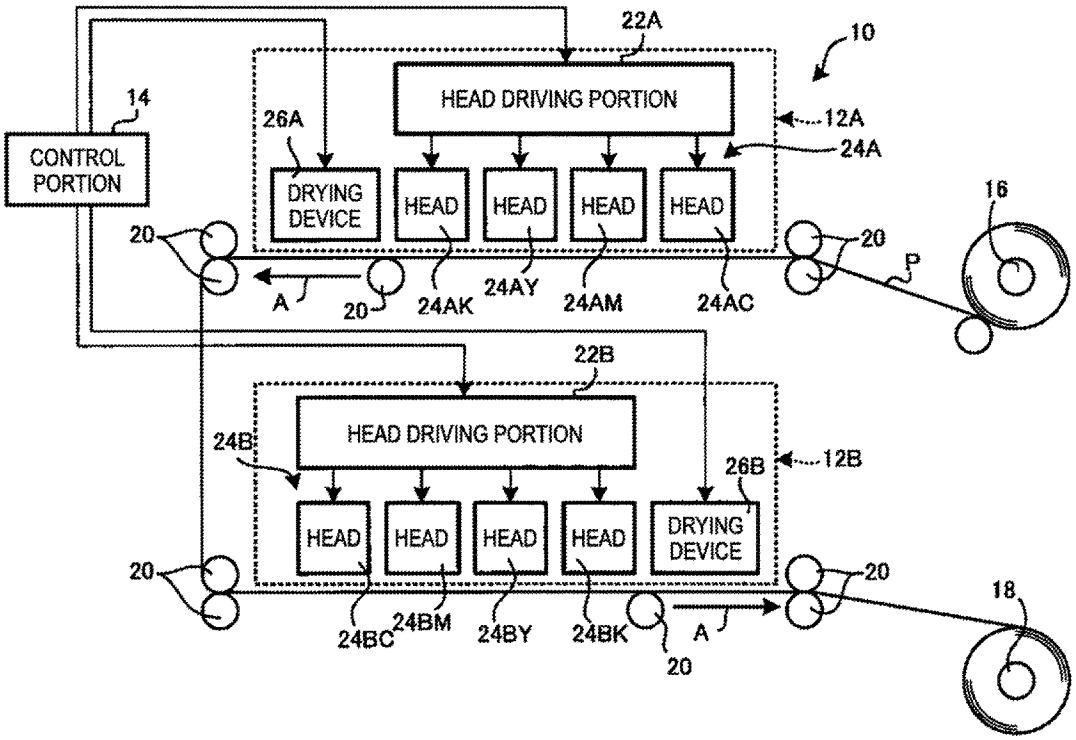
FIG. 1 is a schematic configuration diagram showing an example of a main configuration portion of a droplet ejection type recording apparatus according to a first exemplary embodiment.

10 droplet ejection type recording apparatus
12 (12A, 12B) image forming portion
14 control portion
16 paper supplying roll
18 discharging roll
20 feeding roller
22 (22A, 22B) head driving portion
24 (24A, 24B) head
26 (26A, 26B) drying device
24AC, 24AM, 24AY, 24AK head
24BC, 24BM, 24BY, 24BK head
30 droplet ejecting member
32 nozzle
34 pressure chamber
36 supply port
38 common passage
40 diaphragm
42 piezoelectric element
40A common electrode
42A individual electrode
50 CPU
52 RAM
54 ROM
56 I/O
58 bus
60 microcomputer
62 user interface (UI)
64 hard disk (HDD)
66 communication I/F
70 image formation instruction information accepting portion
72 image information importing portion
74 designated image formation speed information extracting portion
76 reference driving waveform reading portion
78 droplet ejection period calculating portion
80 determination portion
82 image formation speed setting range storage portion

84 droplet ejection period to droplet speed characteristic table storage portion
86 reference driving waveform storage portion
88 image formation pattern generating portion
90 change necessity information generating portion
92 driving waveform correcting portion
94 driving instruction portion
95 acceptance portion
96 pulse selecting portion
97 ON/OFF pattern table storage portion
98 ejection period adjusting portion
99 ejection execution control portion

DETAILED DESCRIPTION

[First Exemplary Embodiment]
(Outline of Apparatus)

FIG. 1 is a schematic configuration diagram showing a main configuration portion of a droplet ejection type recording apparatus 10 as an example of an image forming apparatus according to a first exemplary embodiment.

For example, the droplet ejection type recording apparatus 10 is provided with two image forming portions 12A and 12B, a control portion 14, a paper supplying roll 16, a discharging roll 18, and a plurality of feeding rollers 20. The two image forming portions 12A and 12B can form images on opposite surfaces of a paper sheet P in one feeding.

In addition, the image forming portion 12A is provided with a head driving portion 22A as an example of a droplet ejection control unit. Further, the image forming portion 12A includes heads 24A and a drying device 26A.

Similarly, the image forming portion 12B is provided with a head driving portion 22B as an example of a droplet ejection control unit. Further, the image forming portion 12B includes heads 24B and a drying device 26B.

Incidentally, there is a case where indication of a suffix "A" and a suffix "B" at the ends of signs may be omitted below when it is not necessary to distinguish between the image forming portion 12A and the image forming portion 12B and between common members included in the image forming portion 12A and the image forming portion 12B.

The control portion 14 drives a not-shown paper feeding motor to control rotation of the feeding rollers 20 which are, for example, connected to the paper feeding motor through a mechanism of gears etc.

A long paper sheet P is wound as a recording medium around the paper supplying roll 16. The paper sheet P is fed in a direction of an arrow A (paper feeding direction) in FIG. 1 in accordance with rotation of the feeding rollers 20.

Upon acceptance of image information, the control portion 14 controls the image forming portion 12A based on color information for each pixel of an image contained in the image information. Thus, the image corresponding to the image information is formed on one image formation surface of the paper sheet P.

Specifically, the control portion 14 controls the head driving portion 22A. The head driving portion 22A drives the heads 24A connected to the head driving portion 22A in accordance with droplet ejection timings instructed from the control portion 14, so as to eject droplets as an example of droplets from the heads 24A and form the image corresponding to the image information on the one image formation surface of the fed paper sheet P.

Incidentally, the color information for each pixel of the image included in the image information includes information expressing the color of the pixel uniquely. In the first exemplary embodiment, assume that the color information for each pixel of the image is represented by respective concentrations of yellow (Y), magenta (M), cyan (C), or black (K). Another representation method for expressing the colors of the image uniquely may be used.

The heads 24A include four heads 24AC, 24AM, 24AY and 24AK corresponding to the four colors, i.e. the Y color, the M color, the C color and the K color, respectively. Droplets of the corresponding colors are ejected from the respective heads 24A.

The control portion 14 controls the drying device 26A to dry the droplets of the image formed on the paper sheet P to thereby fix the image to the paper sheet P.

Then, the paper sheet P is fed to a position opposing to the image forming portion 12B in accordance with rotation of the feeding rollers 20. On this occasion, the paper sheet P is turned inside out and fed so that the other image formation surface different from the image formation surface on which the image has been formed by the image forming portion 12A can face the image forming portion 12B.

The control portion 14 also executes, on the image forming portion 12B, similar control to the aforementioned control on the image forming portion 12A. Thus, an image corresponding to the image information can be formed on the other image formation surface of the paper sheet P.

The heads 24B include four heads 24BC, 24BM, 24BY and 24BK corresponding to the four colors, i.e. the Y color, the M color, the C color and the K color, respectively. Droplets of the corresponding colors are ejected from the respective heads 24B.

The control portion 14 controls the drying device 26B to dry the droplets of the image formed on the paper sheet P to thereby fix the image to the paper sheet P.

Then, the paper sheet P is fed to the discharging roll 18 and wound around the discharging roll 18 in accordance with rotation of the feeding rollers 20.

Incidentally, the configuration of the apparatus for forming images on front and back surfaces of a paper sheet P in one feeding starting at the paper supplying roll 16 and ending at the discharging roll 18 has been described as the droplet ejection type recording apparatus 10 according to the first exemplary embodiment. It is however a matter of course that the droplet ejection type recording apparatus 10 may be a droplet ejection type recording apparatus for forming an image on a single surface.

In addition, ink as an example of a droplet includes water-based ink, oil-based ink serving as ink containing a solvent which can be evaporated, ultraviolet-curable type ink, etc. However, assume that water-based ink is used in the first exemplary embodiment. When it is mentioned as "ink" or "droplet" simply in the first exemplary embodiment, it may imply "water-based ink" or "water-based ink droplet".

(Head 24)

Figure 2A:
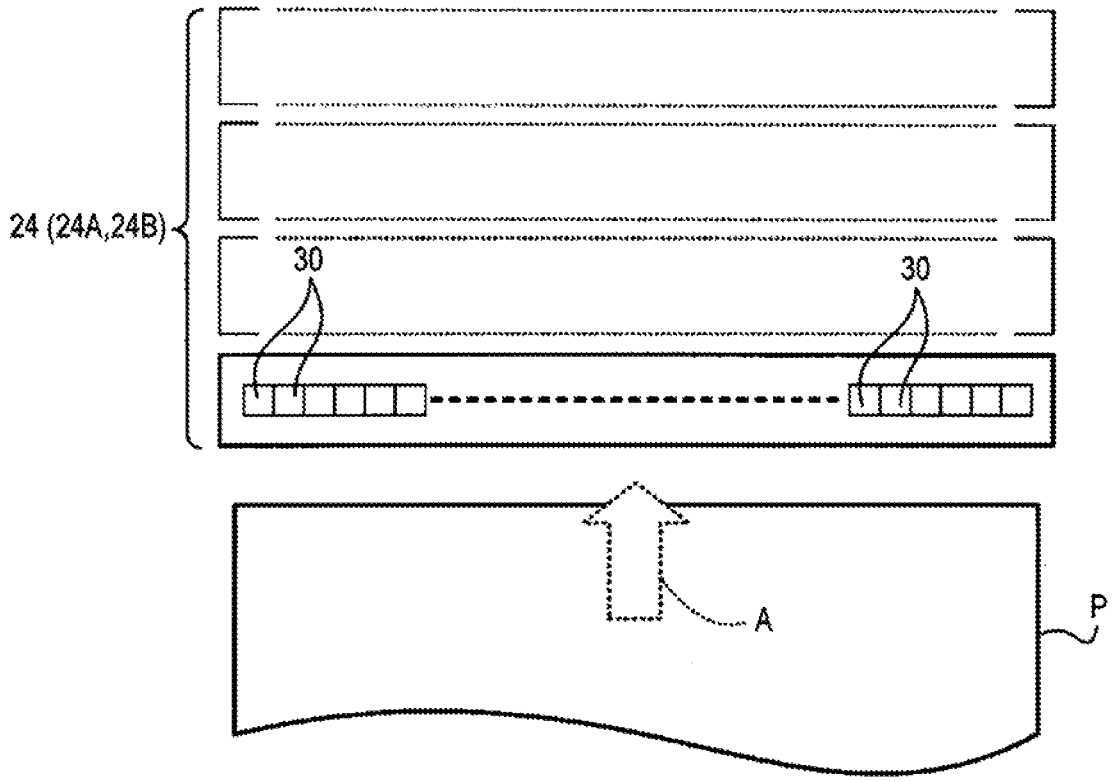
FIGS. 2A and 2B are a plan view of a head according to the first exemplary embodiment and a sectional view showing an internal structure of each droplet ejecting element in the head respectively.

As shown in FIG. 2A, each of the heads 24 applied to the image forming portion 12 has droplet ejecting members 30 which are arranged in a longitudinal direction of the head. Incidentally, the longitudinal direction of the head is a direction intersecting with a feeding direction of the paper sheet P (a direction of an arrow A in FIG. 2A), and may be referred to as main scanning direction. In addition, the feeding direction of the paper sheet P (the direction of the arrow A in FIG. 2A) may be referred to as sub-scanning direction.

The layout of the droplet ejecting members 30 is not limited to a single array line in the main scanning direction. In some dot pitch (resolution), a plurality of array lines of droplet ejecting members 30 provided in the sub-scanning direction may be arrayed two-dimensionally in accordance with predetermined rules so that ejection timing in each array line can be controlled in accordance with the array line pitch and feeding speed of the paper sheet P.

Figure 2B:
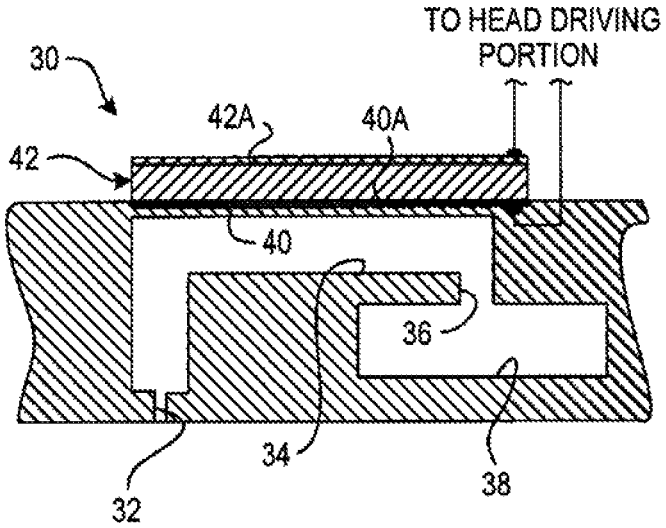

As shown in FIG. 2B, the droplet ejecting members 30 are provided with nozzles 32 and pressure chambers 34 corresponding to the nozzles 32 respectively.

A supply port 36 is provided in each of the pressure chambers 34. The pressure chambers 34 are connected to a common passage (common passage 38) through the supply ports 36.

The common passage 38 has a role of receiving supply of ink from an ink supply tank (not shown) as an ink supply source and distributing the received supply of the ink to the respective pressure chambers 34.

A diaphragm 40 is attached to an upper surface of a ceiling portion of the pressure chamber 34 in each droplet ejecting member 30. In addition, a piezoelectric element 42 is attached to the upper surface of the ceiling portion of the pressure chamber. The diaphragm 40 is provided with a common electrode 40A. The piezoelectric element 42 is provided with an individual electrode 42A. When a voltage is selectively applied between the individual electrode 42A of the piezoelectric element 42 and the common electrode 40A, the selected piezoelectric element 42 is deformed so that a droplet can be ejected from the nozzle 32 and new ink can be supplied from the common passage 38 to the pressure chamber 34.

Each of the head driving portions 22 (22A and 22B) is controlled by the control portion 14 (see FIG. 1) based on the image information to generate a driving signal for applying a voltage to each of the individual electrodes 42A of the piezoelectric elements 42 independently.

To eject each droplet, image formation speed (droplet ejection period) which can guarantee designated image quality can be set in a predetermined setting range (particularly with a maximum image formation speed Vmax as an upper limit).

Incidentally, a lower limit of the setting range is not particularly limited. Theoretically, it will go well as long as the lower limit of the setting range is a positive number (a number larger than 0). In addition, the setting may include one or both of paper feeding speed and the resolution in addition to the image formation speed. The term "image formation speed" which will be referred to simply may include one of the droplet ejection period, the paper feeding speed and the resolution, or all combinations of two or more of the droplet ejection period, the paper feeding speed and the resolution, but do not include any combination incompatible with circumstances.

When there is a change in the setting of the image formation speed, frequency control (droplet ejection period control) is executed on each of the heads 24 by the head driving portion 22.

Figure 3:
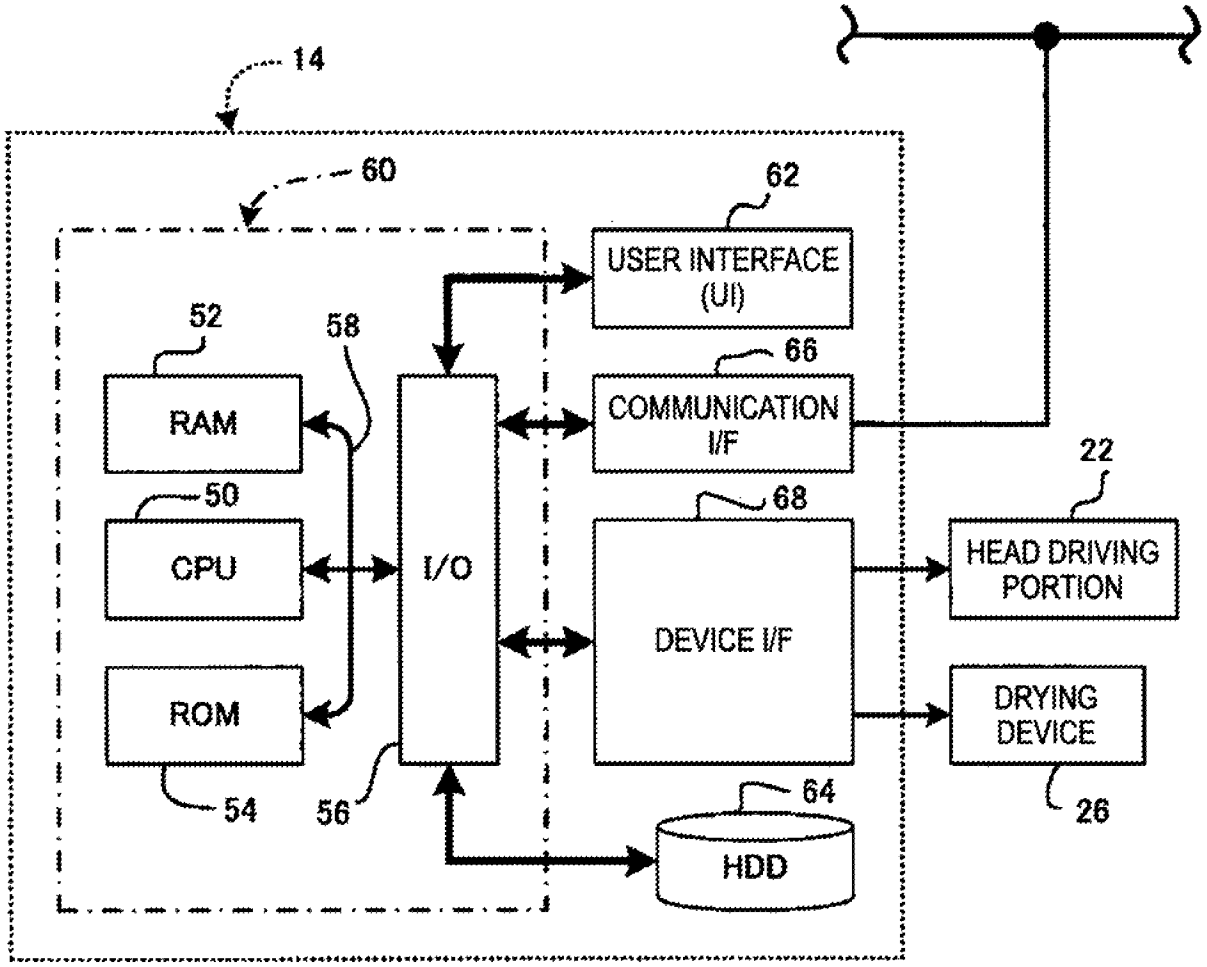
FIG. 3 is a block diagram of a control portion according to the first exemplary embodiment.

As shown in FIG. 3, the control portion 14 is equipped with a microcomputer 60. The microcomputer 60 is provided with a CPU 50, an RAM 52, an ROM 54, an I/O 56, and a bus 58. The bus 58 such as a data bus or a control bus connects the CPU 50, the RAM 52, the ROM 54 and the I/O 56 to each other.

A user interface (UI) 62, a hard disk (HDD) 64, and a communication I/F 66 which is performed by radio (or cable) are connected to the I/O 56. In addition, a device I/F 68 which serves as a connection terminal to any of external devices (the head driving portions 22 and the drying devices 26 in the first exemplary embodiment) is connected to the I/O 56.

Here, in a specific high-frequency band exceeding the upper limit (Vmax) which can guarantee the image quality, droplet speed or a droplet amount fluctuates in accordance with residual pressure vibration (see a frequency band fm in FIG. 5A and a period range width Tm in FIG. 5B) of each piezoelectric element 42. Therefore, the image formation speed is limited to the setting range (upper limit) which is not affected by the pressure vibration.

In other words, at an image formation speed exceeding a frequency corresponding to the maximum image formation speed Vmax serving as the upper limit, a landing position of the droplet on the paper sheet P or the size of the landed droplet varies to thereby lower the image quality.

On the other hand, in the first exemplary embodiment, control for suppressing the fluctuation in the droplet speed or the droplet amount is constructed in the frequency band in which the droplet speed or the ink droplet amount fluctuates (the specific high-frequency band exceeding the frequency corresponding to the maximum speed Vmax).

That is, in the first exemplary embodiment, period adjustment control is executed in the following control procedures in the control portion 14 and the head driving portion 22.

Figure 5A:
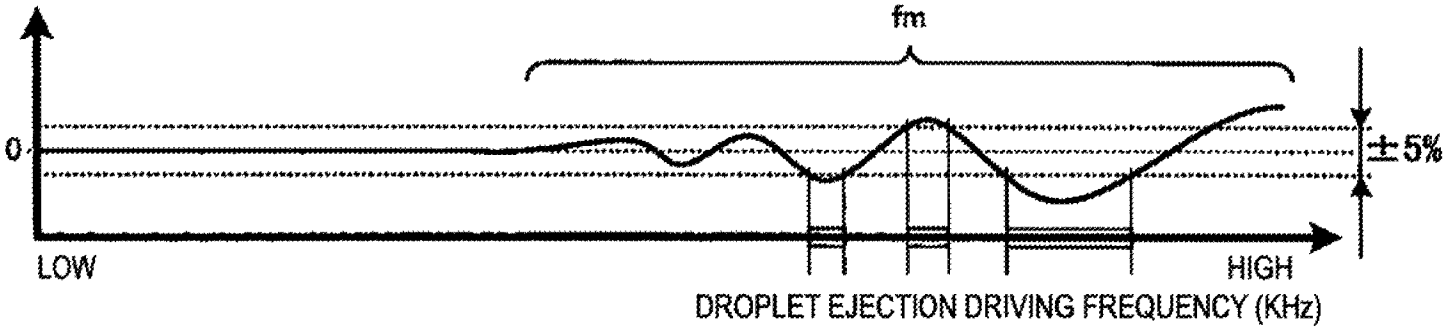
FIGS. 5A and 5B are a droplet ejection driving frequency to droplet speed fluctuation amount characteristic graph and a droplet ejection period to droplet speed fluctuation amount characteristic graph respectively.
Figure 5B:
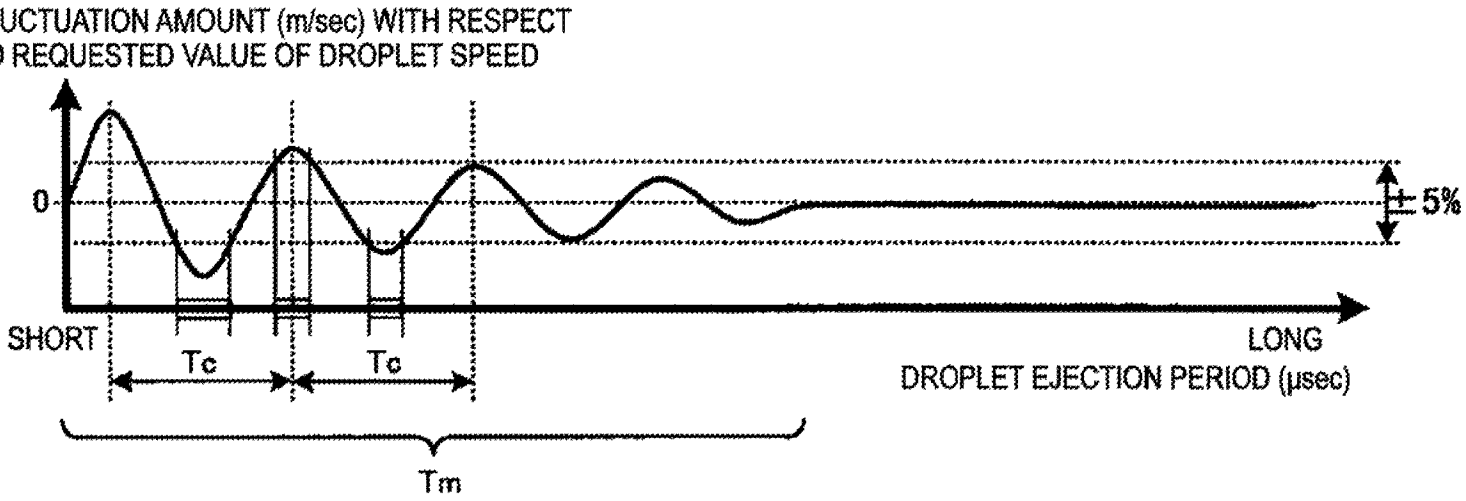

(Control Procedure 1) When a droplet ejection frequency (droplet ejection period) is determined in accordance with the image formation speed which is set to exceed the upper limit of the setting range, determination is made as to whether residual pressure vibration is less than ±5% or not, based on FIG. 5A or FIG. 5B.

Figure 6A:
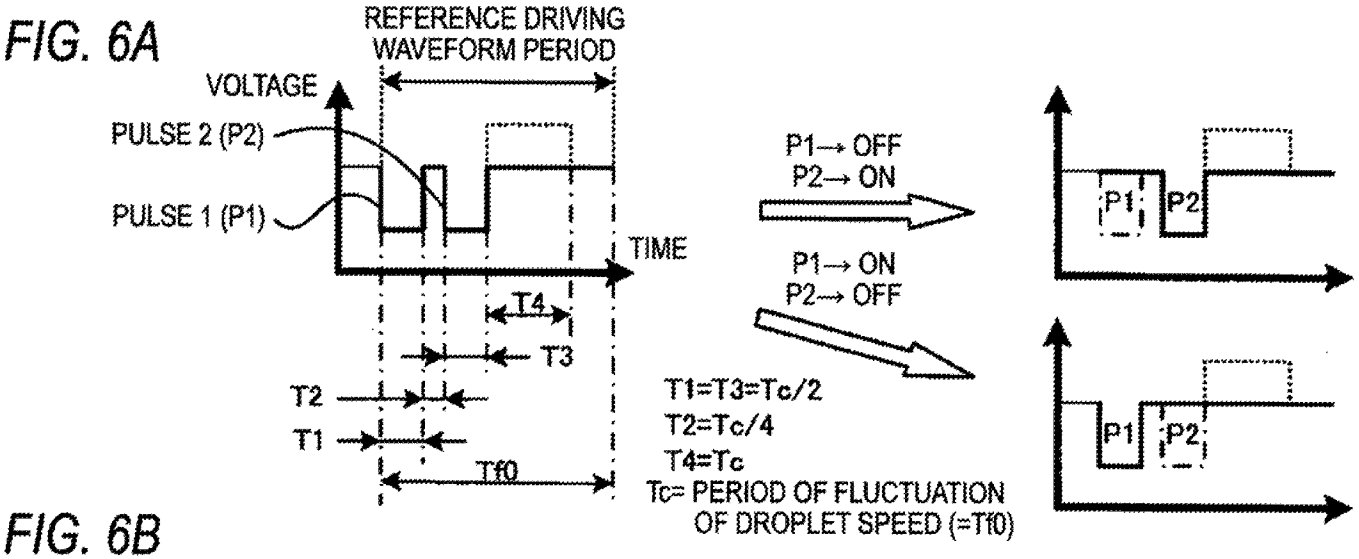
FIGS. 6A, 6B, 6C and 6D are a reference driving waveform graph and waveform graphs after selection of pulses, a timing chart of adjusted driving periods, a timing chart of each steady driving period, and a timing chart showing a positional relation between the adjusted driving periods and the steady driving period, according to the first exemplary embodiment, respectively.

(Control Procedure 2) As shown in FIG. 6A, a pulse 1 or a pulse 2 is suitably selected (ON/OFF) in a reference driving waveform of a reference driving waveform period (Tf0) including the pulse 1 and the pulse 2. Thus, two kinds of driving waveforms are generated.

As shown in FIG. 6A, the reference driving waveform has the period Tf0 (reference driving waveform period). The reference driving waveform is a waveform in which the pulse 1 of a droplet ejection time T1 is outputted in a rising edge, and the pulse 2 of a droplet ejection time T3 is then outputted after a lapse of an interval time T2.

Here, there is a case where a pulse signal (see a dotted line in FIG. 6A) which is set to have a width of a time T4 and is convex reversely to the pulse 1 and the pulse 2 may be outputted immediately after the pulse 2.

In the reference driving waveform in FIG. 6A, the pulse signal of the aforementioned dotted line portion is intended to reduce vibration caused by droplet ejection. In other words, since the pulse signal is unnecessary in view of droplet ejection, it is designated by the dotted line in FIG. 6A.

Figure 6B:
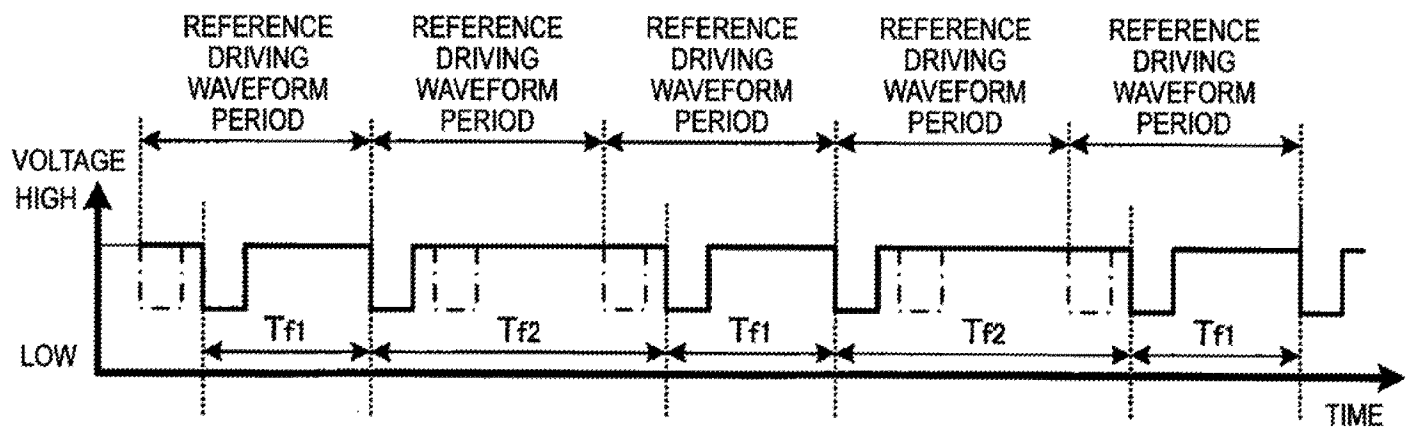
Figure 6C:
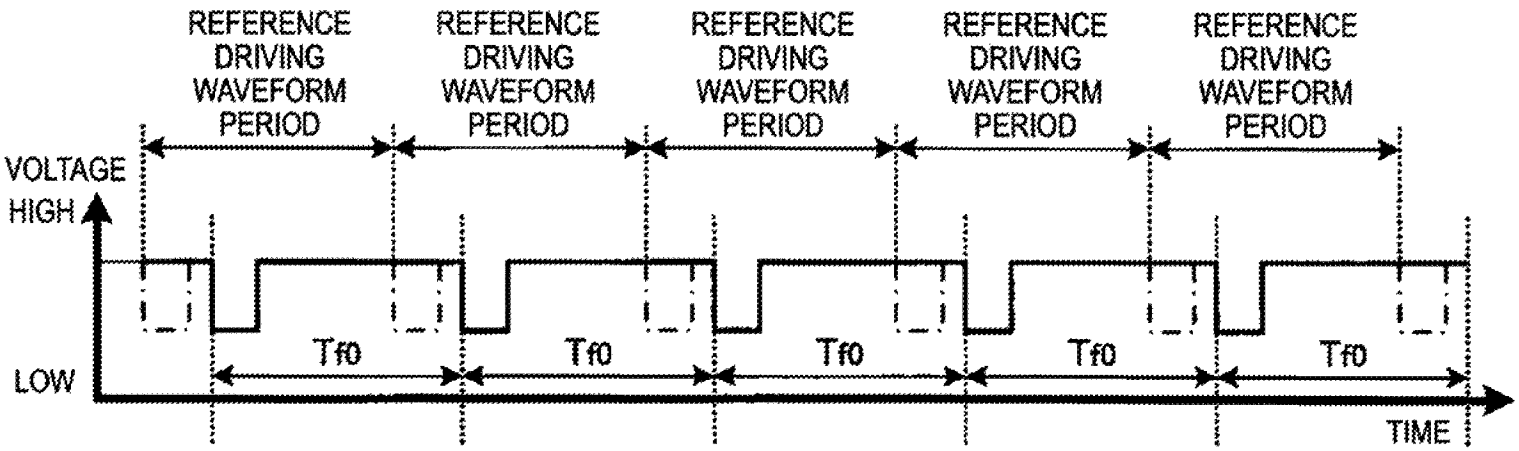

Incidentally, although the pulse of the dotted line portion for reducing the vibration is not shown in FIG. 6B, FIG. 6C and FIG. 8 which will be described later, it is preferable that practical driving waveforms are used as driving waveforms including the pulses of the dotted line portions.

In the first exemplary embodiment, each of the droplet ejection times T1 and T3 is equal to a time Tc/2. The interval time T2 between the pulse 1 and the pulse 2 is a time Tc/4. The time T4 of the pulse for reducing the vibration is set as a time Tc. As shown in FIG. 5B, the time Tc is a period of fluctuation with respect to a requested value of the droplet speed so as to be consistent with the reference driving waveform period Tf0.

Here, the pulse 1 (P1) or the pulse 2 (P2) is selected (ON/OFF) in the reference driving waveform in FIG. 6A. Thus, two kinds of driving waveforms can be generated.

Incidentally, in the first exemplary embodiment, as an example for generating each of the driving waveforms, the reference driving waveform is outputted to the head driving portion 22 from the control portion 14 regardless of the condition of the control procedure 1, and then, the pulse 1 or the pulse 2 is selected to be ON/OFF in the head driving portion 22 based on the condition of the control procedure 1.

(Control Procedure 3 "not Less than Range of ±5%")

A driving waveform in which the pulse 1 is set OFF and the pulse 2 is set ON in the reference driving waveform and a driving waveform in which the pulse 1 is set ON and the pulse 2 is set OFF in the reference driving waveform are generated and outputted alternately. Thus, a period Tf1 shorter by (Tc/4)×n than the droplet ejection period Tf0 and a period Tf2 longer by (Tc/4)×n than the designated droplet ejection period Tf0 are repeated (see FIG. 68). Incidentally, Tc is the period for the residual pressure vibration in FIG. 5B so as to be consistent with Tf0. In addition, n is an odd number among integers. In the first exemplary embodiment, the relation n=3 is established (that is, ±3Tc/4).

As a result, the periods are shifted from the designated period Tf0 by ±3Tc/4 respectively. Accordingly, the period for the residual pressure vibration is secured to be less than ±5% and the designated period Tf0 is secured in the entire period (see FIG. 6D).

(Control Procedure 4 "Less than Range of ±5%")

A single driving waveform in which the pulse 1 is set OFF and the pulse 2 is set ON in the reference driving waveform is generated and outputted. Thus, the droplet ejection period Tf0 is maintained (see FIG. 6C).

Figure 4:
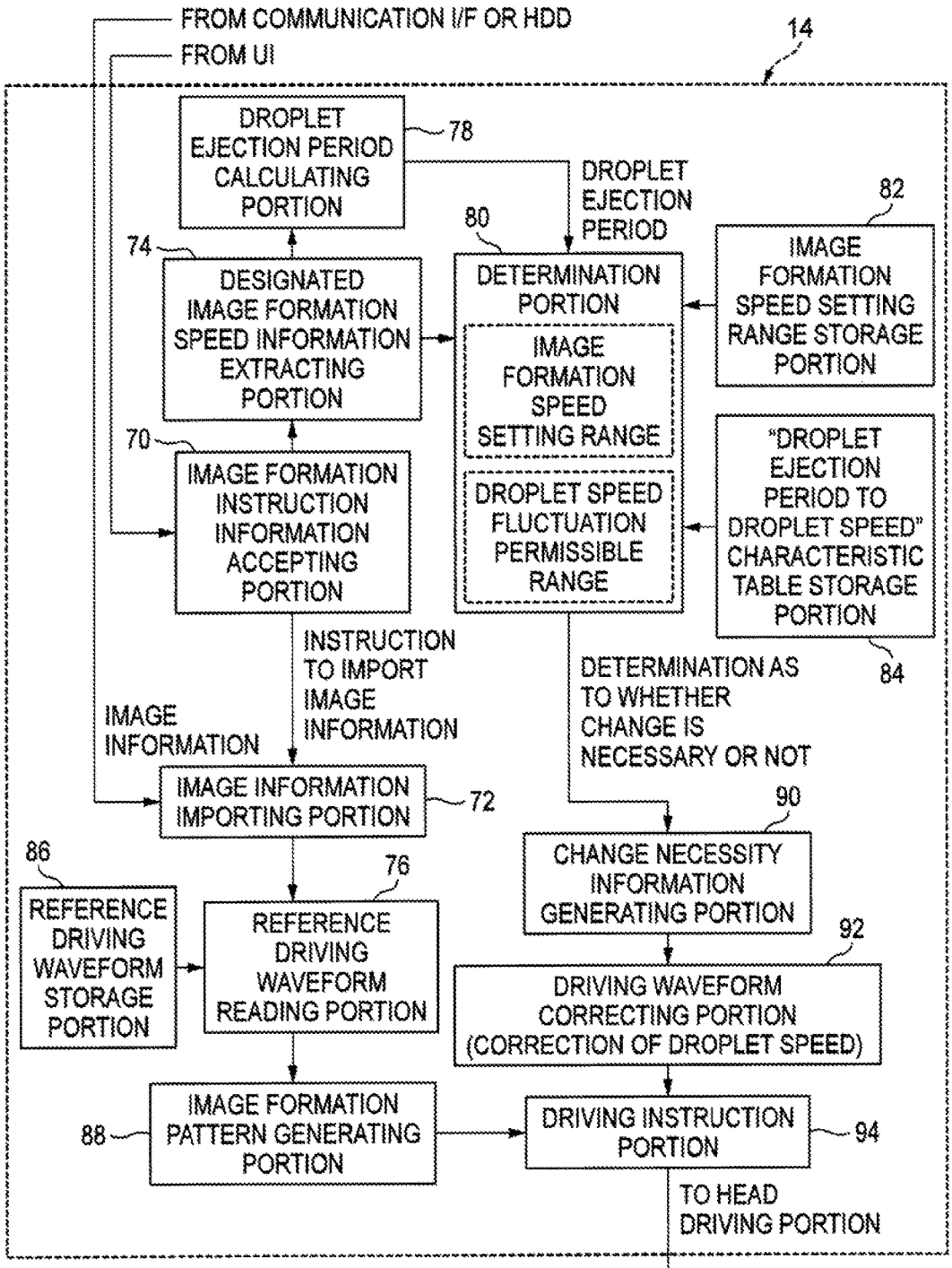
FIG. 4 is a functional block diagram showing blocked parts of period adjustment control in the control portion according to the first exemplary embodiment.

FIG. 4 is a functional block diagram showing blocked parts of period adjustment control in the control portion 14 for suppressing fluctuation in the droplet speed or the droplet amount in control concerned with ejection control of a droplet from each droplet ejecting member 30. Incidentally, the respective blocked parts of the functional block diagram of FIG. 4 do not limit the hardware configuration of the control portion 14.

An image formation instruction is accepted from the UI62 (see FIG. 3) by an image formation instruction information accepting portion 70. The image formation instruction information accepting portion 70 is connected to an image information importing portion 72 and a designated image formation speed information extracting portion 74.

The image information importing portion 72 imports image information from the communication I/F 66 or the HDD 64 (see FIG. 3) based on the image information importing instruction received from the image formation instruction information accepting portion 70, and sends the imported image information to a reference driving waveform reading portion 76.

A reference driving waveform storage portion 86 is connected to the reference driving waveform reading portion 76. Upon acceptance of the image information from the image information importing portion 72, the reference driving waveform reading portion 76 reads a reference driving waveform from the reference driving waveform storage portion 86 and sends the read reference driving waveform to an image formation pattern generating portion 88.

By the image formation pattern generating portion 88, an image formation pattern (presence/absence of droplet ejection based on main scanning and sub-scanning) is generated based on the image information and an ejection period, and sent to a driving instruction portion 94. The driving instruction portion 94 serves as an example of an output unit.

On the other hand, designated image formation speed (which may include paper feeding speed and/or resolution) is extracted from the image formation instruction information by the designated image formation speed information extracting portion 74. The extracted image formation speed is sent to a droplet ejection period calculating portion 78 and a determination portion 80. The determination portion 80 serves as an example of a determination unit.

By the droplet ejection period calculating portion 78, a droplet period (droplet ejection period) is calculated based on the image formation speed accepted from the designated image formation speed information extracting portion 74, and sent to the determination portion 80. Incidentally, although the calculation result may be a droplet ejection frequency (a reciprocal number of the period), it is assumed here that the period is calculated in conformity with FIG. 5B.

An image formation speed setting range storage portion 82 and a droplet ejection period to droplet speed characteristic data table storage portion 84 are connected to the determination portion 80. Determination about the following two conditions is made by the determination portion 80.

(Determination 1) Determination is made as to whether the designated image formation speed is within a setting range or not (particularly exceeds a maximum speed Vmax as an upper limit or not)

(Determination 2) Determination is made as to whether fluctuation in droplet speed is within a permissible range or not (for example, less than ±5% shown in FIGS. 5A and 5B or not). Incidentally, the determination 2 may be made when the designated image formation speed exceeds the setting range in the determination 1.

The determination result made by the determination portion 80 is sent to a change necessity information generating portion 90. Adjustment necessity information required for selection of the pulse 1 and the pulse 2 included in the reference driving waveform is generated by the change necessity information generating portion 90.

The change necessity information generating portion 90 is connected to a driving waveform correcting portion 92.

The driving waveform correcting portion 92 executes correction of each landing position on a paper sheet P. The correction is an event occurring in the case where determination has been made that the ejection period has to be adjusted and the ejection period has been adjusted. More specifically, as shown in FIG. 8, the driving waveform is corrected to thereby change the droplet speed for ejecting a droplet from each nozzle 32 (see FIG. 2B).

The driving waveform correcting portion 92 is connected to the driving instruction portion 94.

The image formation pattern generated by the image formation pattern generating portion 88 and the adjustment necessity information (including correction information added if necessary) are sent to the head driving portion 22 (see FIG. 1) by the driving instruction portion 94.

The image formation pattern and the adjustment necessity information (including the correction information of the droplet speed added if necessary) are accepted by an acceptance portion 95 of the head driving portion 22.

The adjustment necessity information is extracted and sent to a pulse selecting portion 96 by the acceptance portion 95.

An ON/OFF pattern table storage portion 97 is connected to the pulse selecting portion 96.

As shown in FIG. 4, a table indicating the relation between adjustment necessity and ON/OFF patterns of the pulse 1 and the pulse 2 is stored in the ON/OFF pattern table storage portion 97.

By the pulse selecting portion 96, the pulse 1 and/or the pulse 2 included in the reference driving waveform are/is selected based on the ON/OFF pattern table, and sent to an ejection period adjusting portion 98. The ejection period adjusting portion 98 serves as an example of an adjustment unit.

A reference driving waveform which is an image formation pattern is extracted from the acceptance portion 95 by the ejection period adjusting portion 98.

Therefore, when adjustment is determined to be unnecessary as an adjustment necessity determination result, a single driving waveform with a steady ejection period Tf0 in which the pulse 1 is set ON and the pulse 2 is set OFF is generated by the ejection period adjusting portion 98.

On the other hand, when adjustment is determined to be necessary as an adjustment necessity determination result, a driving waveform with an adjusted ejection period Tf1 in which the pulse 1 is set OFF and the pulse 2 is set ON and a driving waveform with an adjusted ejection period Tf2 in which the pulse 1 is set ON and the pulse 2 is set OFF are generated by the ejection period adjusting portion 98.

An ejection execution control portion 99 serving as an example of a droplet ejection control unit is connected to the ejection period adjusting portion 98 to thereby execute ejection of each droplet based on an ejection period set as either the steady ejection period or one of the adjusted ejection periods.

An effect of the first exemplary embodiment will be described below in accordance with flow charts of FIGS. 7A and 7B.

Figure 7A:
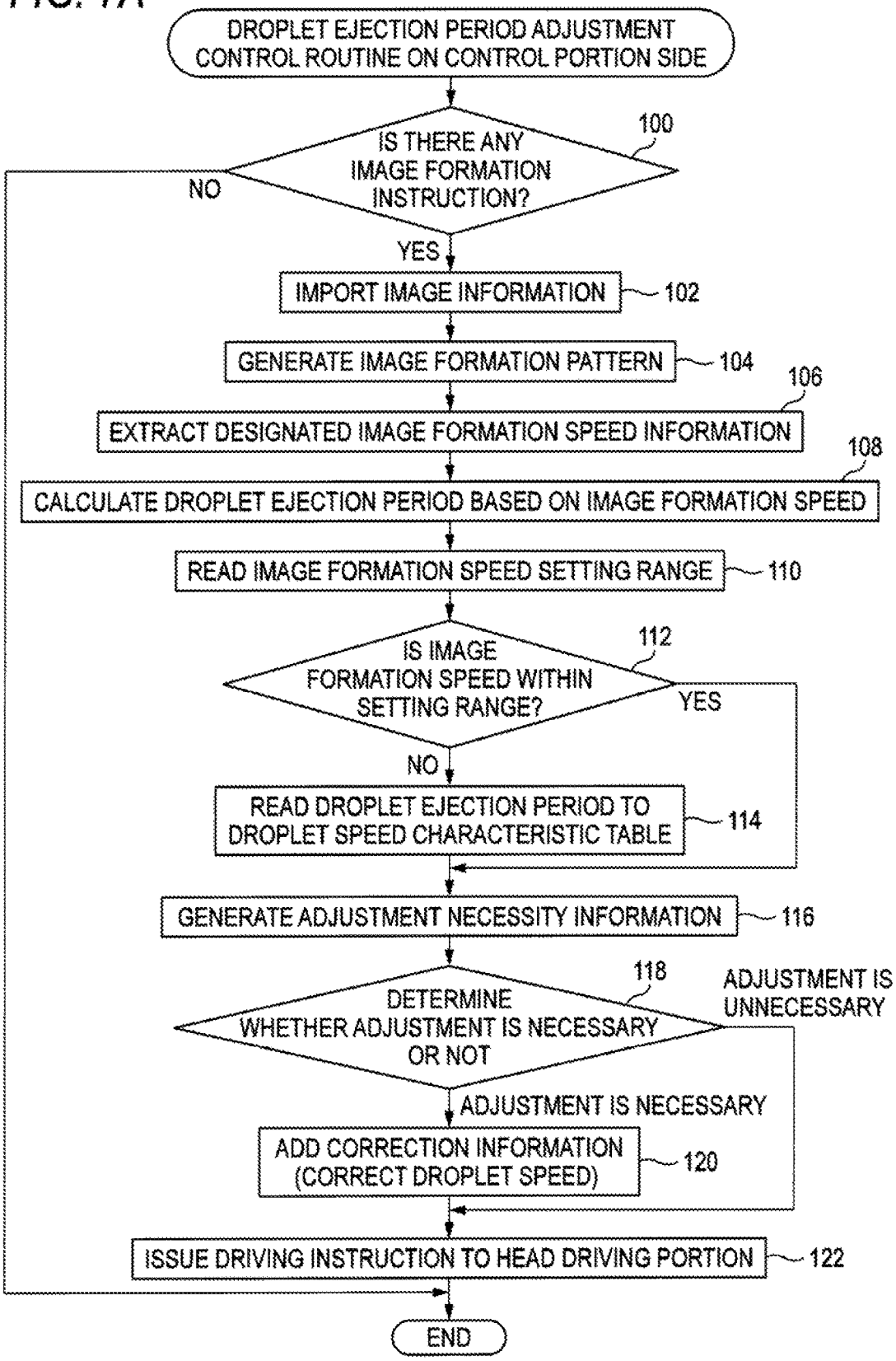

FIG. 7A is the flow chart showing the flow of period adjustment control performed by the control portion 14 for suppressing fluctuation in droplet speed or droplet amount in control concerned with ejection control of a droplet from each droplet ejecting member 30. FIG. 7B is the flow chart showing the flow of period adjustment control performed by the head driving portion 22 for suppressing fluctuation in droplet speed or droplet amount in control concerned with ejection control of a droplet from the droplet ejecting member 30.

(Control on Control Portion 14 Side)

As shown in FIG. 7A, determination is made as to whether there is an image formation instruction or not in a step 100. When the determination results in NO, the routine is terminated. In addition, when the determination results in YES in the step 100, the routine goes to a step 102 in which image information is imported by the image information importing portion 72. Then, the routine goes to a step 104 in which an image formation pattern is generated. Then, the routine goes to a step 106.

In the step 106, designated image formation speed information is extracted. Then, the routine goes to a step 108.

In the step 108, each droplet ejection period is calculated based on the image formation speed. Next, in a step 110, image formation speed setting range information (table) is read from the image formation speed setting range storage portion 82. The routine goes to a step 112 in which determination is made as to whether the image formation speed is within the setting range or not.

When the determination results in YES in the step 112, the routine goes to a step 116.

In addition, when the determination results in NO in the step 112, conclusion is made that the image formation speed is out of the setting range. Then, the routine goes to a step 114 in which a "droplet ejection period to droplet speed" characteristic table is read from the "droplet ejection period to droplet speed" characteristic table storage portion 84. Then, the routine goes to the step 116.

In the step 116, adjustment necessity information of the droplet ejection period depending on the image formation speed is generated.

That is, when the image formation speed is within the setting range, adjustment of the droplet ejection period is unnecessary (adjustment is unnecessary). When the image formation speed is out of the setting range and an error of the residual vibration is not less than ±5%, information indicating that the adjustment is necessary (adjustment is necessary) is generated.

In a next step 118, determination is made as to whether correction of the driving waveform is necessary or not. That is, when determination is made that adjustment of the droplet ejection period is unnecessary, correction of the driving waveform is unnecessary. On the other hand, when determination is made that adjustment of the droplet period is necessary, it is necessary to correct the driving waveform using the droplet speed correspondingly to a deviation in the ejection timing.

Therefore, when determination is made that correction is necessary in the step 118, the routine goes to a step 120 in which correction information of the driving waveform (correction of the droplet speed) is added to the adjustment necessity information (see FIG. 8, and details will be given later). Then, the routine goes to a step S122.

On the contrary, when determination is made that correction is unnecessary in the step 118, correction information is not added to the adjustment necessity information. Then, the routine goes to the step 122.

In the step 122, the image formation pattern information (the step 104), the adjustment necessity information (the step 116) and the correction information of the droplet speed if necessary (the step 120) are sent as driving instruction information to the head driving portion 22. Then, the routine is terminated.

Incidentally, control of the head driving portion 22 which will be described below may be executed in a lump by the control portion 14.

(Control on Head Driving Portion 22 Side)

As shown in FIG. 7B, determination is made in a step 150 as to whether a driving instruction has been accepted or not. When the determination results in NO, the routine is terminated.

In addition, when the determination results in YES in the step 150, the routine goes to a step 152 in which adjustment necessity information is extracted from the driving instruction information. Then, the routine goes to a step 154.

In the step 154, a pulse ON/OFF pattern table is read from the pulse ON/OFF pattern table storage portion 97. Next, the routine goes to a step 156.

In the step 156, a period kind (steady ejection period or adjusted ejection period) is determined based on the adjustment necessity information. Then, the routine goes to a step 158.

When determination is made in the step 158 that the period kind is adjusted ejection period, the routine goes to a step 160 in which a reference driving waveform is read from the driving instruction information. Next, the routine goes to a step 162 in which an adjusted ejection period Tf1 and an adjusted ejection period Tf2 are generated based on the reference driving waveform with reference to the pulse ON/OFF pattern table. Then, the routine goes to a step 168 (see FIG. 6A and FIG. 6B).

On the other hand, when determination is made in the step 158 that the period kind is steady ejection period, the routine goes to a step 164 in which a reference driving waveform is read from the driving instruction information. Next, the routine goes to a step 166 in which a steady ejection period Tf0 is generated based on the reference driving waveform with reference to the pulse ON/OFF pattern table. The routine goes to the step 168 (see FIG. 6A and FIG. 6C).

In the step 168, droplet ejection is executed based on the generated ejection period or periods (the steady ejection period or the adjusted ejection periods). Then, the routine is terminated.

Here, correction of the driving waveform in the step 120 in FIG. 7A will be described in detail.

Figure 6D:
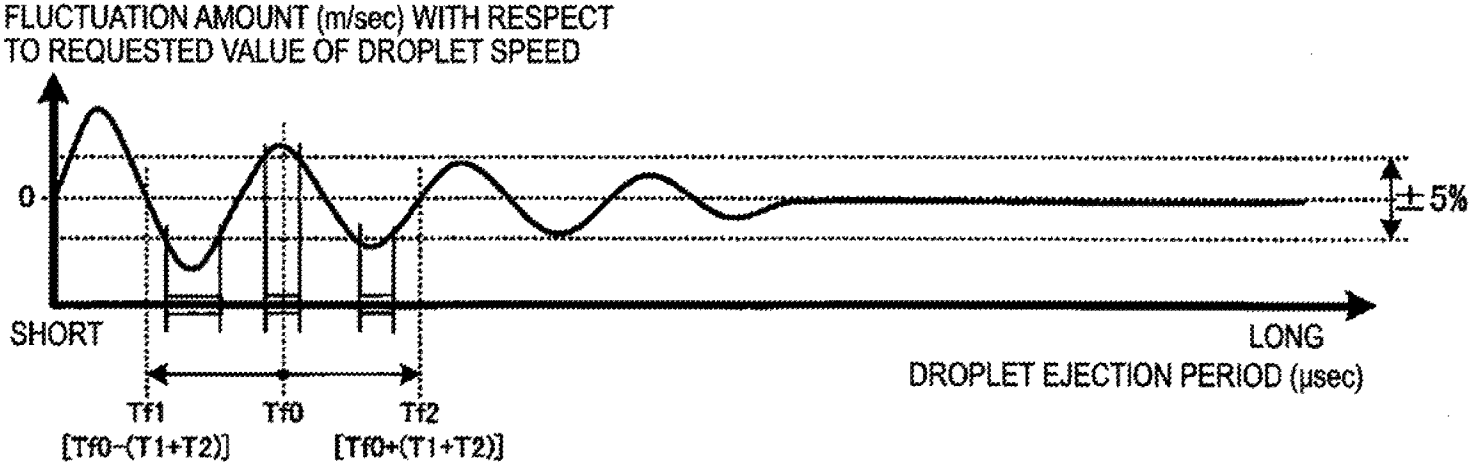
Figure 8:
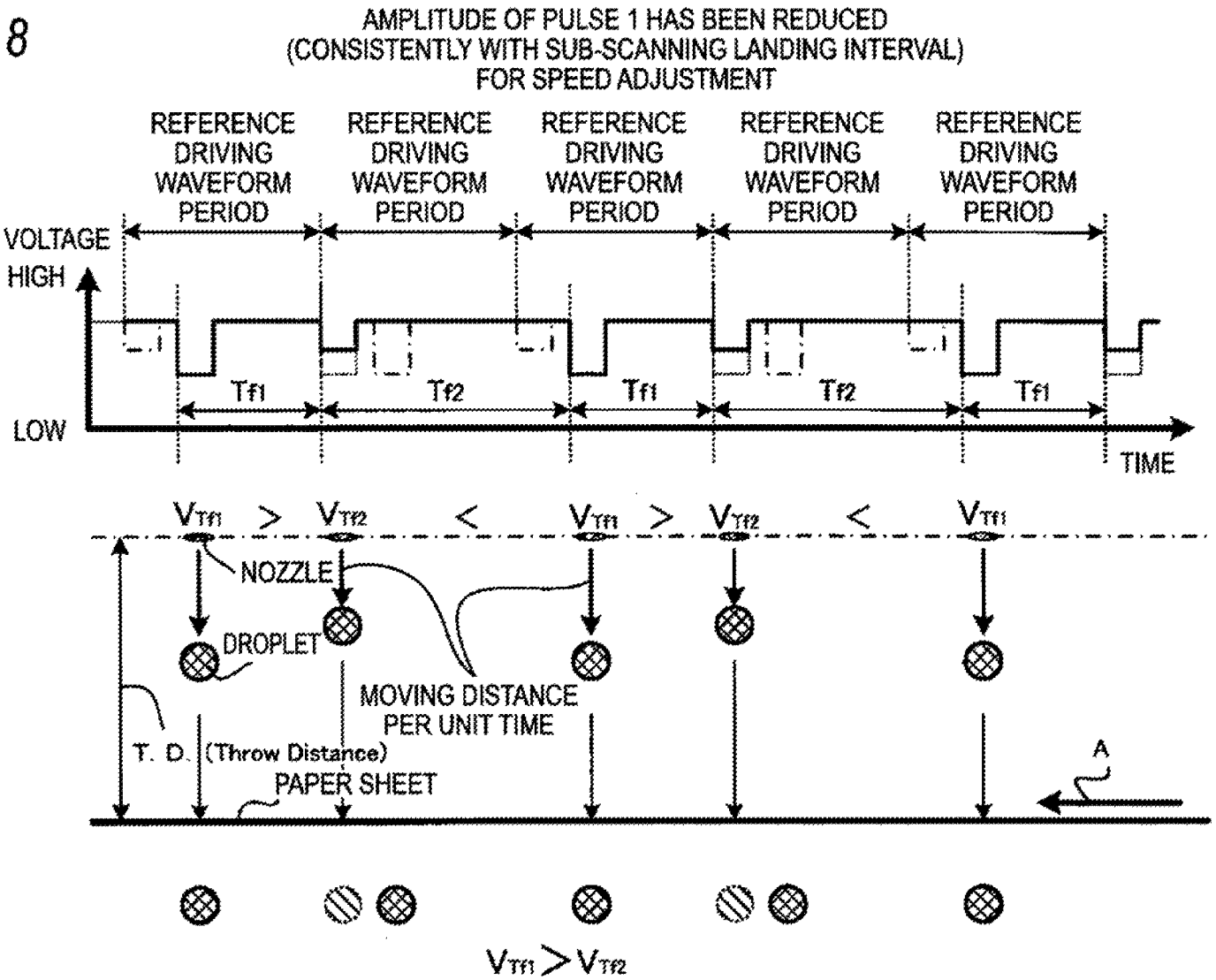
FIG. 8 is a timing chart showing details of correction of a driving waveform in a step 120 of FIG. 7.

As shown in FIG. 8, when the adjusted ejection periods Tf1 and Tf2 are generated for ejecting droplets, every second droplet is ejected earlier by a period (3Tc/4)×2 (see FIG. 6D). When every second droplet is ejected earlier by a period (3Tc/4)×2, droplets ejected at the period Tf2 can reach a paper sheet P earlier than droplets ejected at the period Tf1, as designated by dotted line positions in FIG. 8. The paper sheet P is fed in a direction of an arrow A in FIG. 8.

In this case, unstable fluctuation in ejection timing among droplets can be avoided due to the ejection timing control based on the period adjustment. However, for example, in accordance with some threshold for determining whether the image quality is good or poor, the image quality may be determined to be poor.

Therefore, correction is performed in such a manner that an ejection speed VTf2 of the period Tf2 whose ejection timing is earlier by the period (3Tc/4)×2 with respect to the period Tf1 is made slower than an ejection speed VTf1 of the period Tf1. The speed correction is set based on a distance (T.D. "Throw Distance") between the nozzle and the paper sheet.

Due to the correction, the droplets ejected at the period Tf2 are displaced to solid line positions from the dotted line positions in FIG. 8 on the paper sheet P so that an interval between adjacent ones of the droplets can be constant.

Incidentally, the invention is not limited to the case where one of the ejection speeds is adjusted to the other ejection speed. To describe in an extreme manner, the two speeds may be corrected so that the sum of added values of correction ratios can reach 100%.

For example, with reference to an intermediate point, the ejection speed VTf1 of the period Tf1 may be made slower by 50% of an amount to be corrected and the ejection speed VTf2 of the period Tf2 may be made faster by 50% of the amount to be correct.

[Second Exemplary Embodiment]

A second exemplary embodiment will be described below. Incidentally, in the second exemplary embodiment, the same portions as those in the first exemplary embodiment will be referred to by the same signs respectively and correspondingly, and description thereof will be omitted.

The second exemplary embodiment is characterized in the following point. That is, a period (Tf1) shorter by 5Tc/4 than a steady ejection period Tf0 (i.e. corresponding to a fluctuation period Tc) used as a reference and a period (Tf2) longer by 5Tc/4 than the designated droplet ejection period Tf0 are set as adjusted ejection periods Tf1 and Tf2.

In the second exemplary embodiment, period adjustment control is executed in the following control procedures in a control portion 14.

(Control Procedure 1) When a droplet ejection frequency (droplet ejection period) is determined in accordance with an image formation speed which is set to exceed an upper limit of a setting range, determination is made as to whether residual pressure vibration is less than ±5% or not, based on FIG. 5A or FIG. 5B.

Figure 9A:
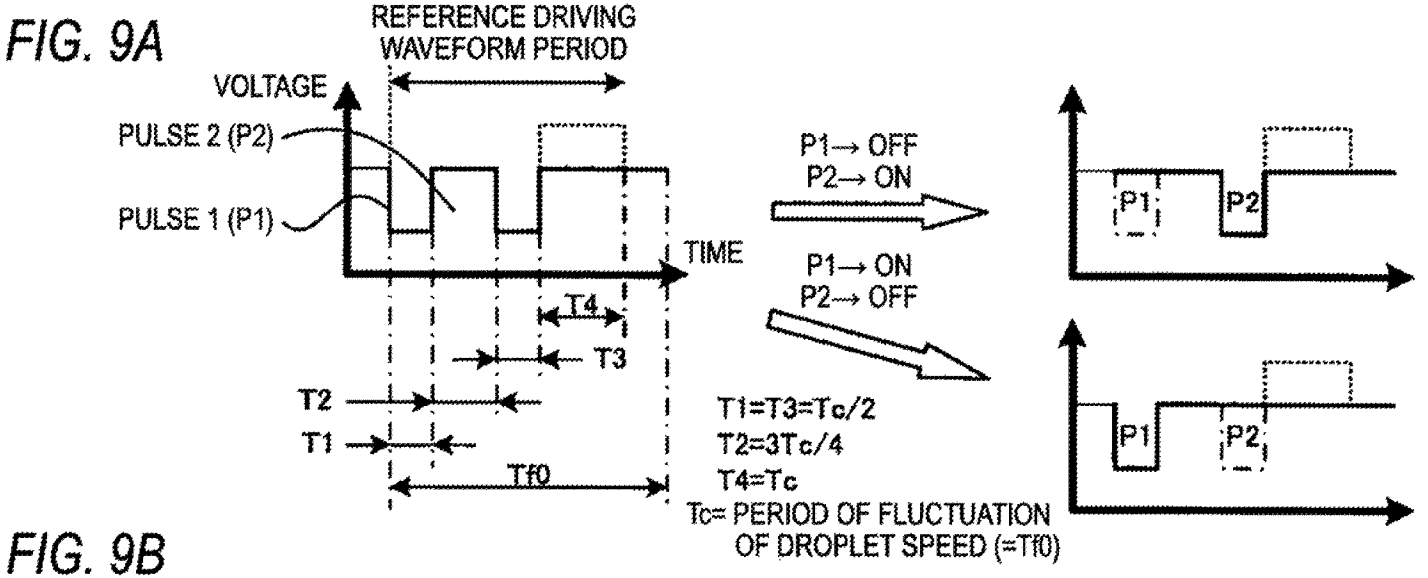
FIGS. 9A, 9B, 9C and 9D are a reference driving waveform graph and waveform graphs after selection of pulses, a timing chart of adjusted driving periods, a timing chart of each steady driving period, and a timing chart showing a positional relation between the adjusted driving periods and the steady driving period, according to a second exemplary embodiment, respectively.

(Control Procedure 2) As shown in FIG. 9A, a pulse 1 or a pulse 2 is suitably selected (ON/OFF) in a reference driving waveform of a reference driving waveform period (Tf0) including the pulse 1 and the pulse 2. Thus, two kinds of driving waveforms are generated.

As shown in FIG. 9A, the reference driving waveform has the period Tf0 (reference driving waveform period). The reference driving waveform is a waveform in which the pulse 1 of a droplet ejection time T1 is outputted in a rising edge, and the pulse 2 of a droplet ejection time T3 is then outputted after a lapse of an interval time T2.

Here, there is a case where a pulse signal (see a dotted line in FIG. 9A) which is set to have a width of a time T4 and is convex reversely to the pulse 1 and the pulse 2 may be outputted immediately after the pulse 2.

In the reference driving waveform in FIG. 9A, the pulse signal of the aforementioned dotted line portion is intended to reduce vibration caused by droplet ejection. In other words, since the pulse signal is unnecessary in view of droplet ejection, it is designated by the dotted line in FIG. 9A.

Figure 9B:
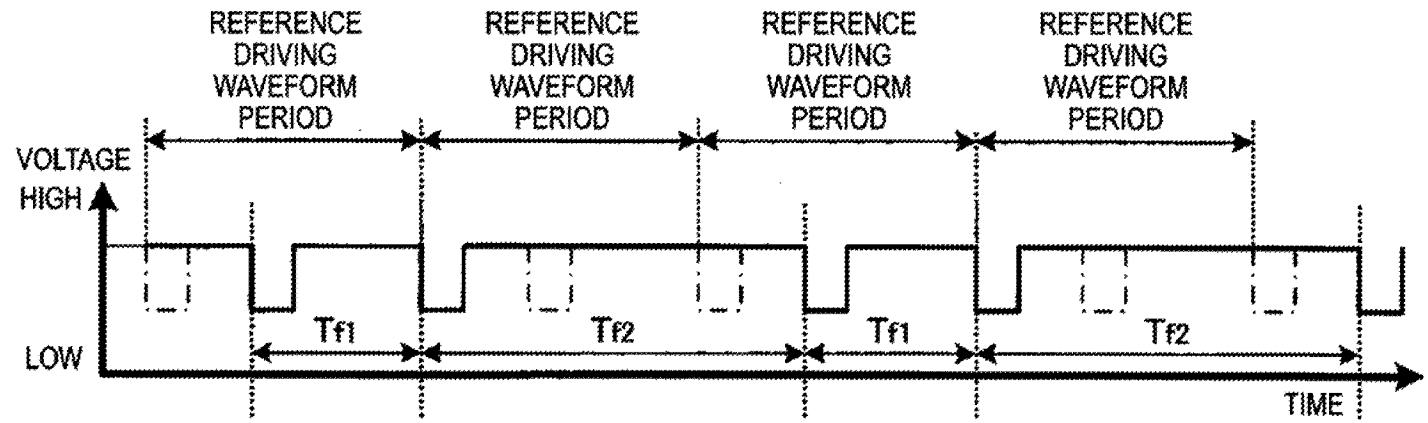
Figure 9C:
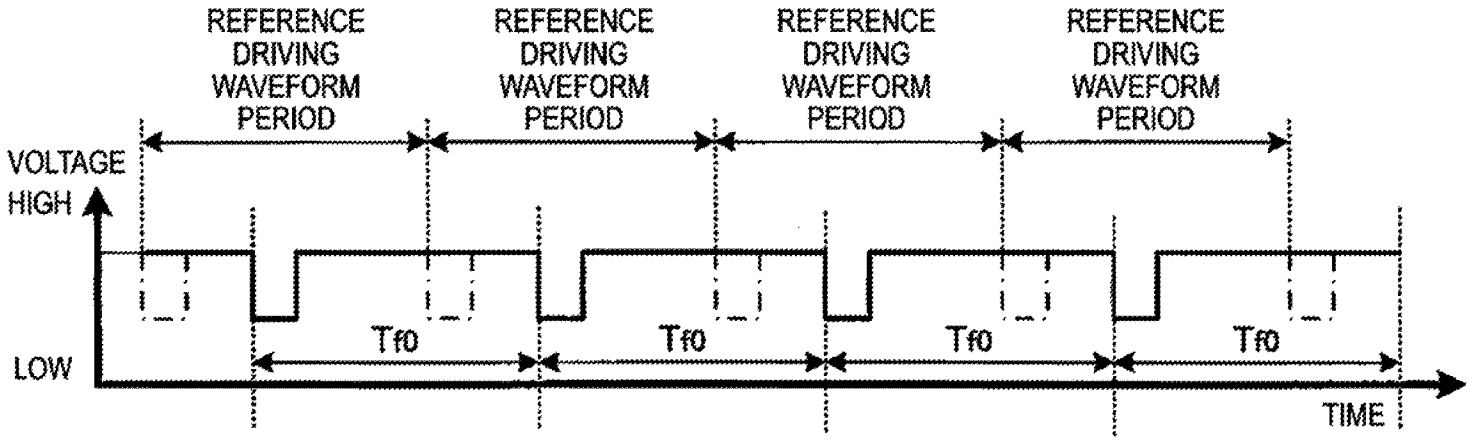

Incidentally, although the pulse of the dotted line portion for reducing the vibration is not shown in FIG. 9B and FIG. 9C, it is preferable that practical driving waveforms are used as driving waveforms including the pulses of the dotted line portions.

In the second exemplary embodiment, each of the droplet ejection times T1 and T3 is equal to a time Tc/2. The interval time T2 between the pulse 1 and the pulse 2 is a time 3Tc/4. The time T4 of the pulse for reducing the vibration is set as a time Tc. As shown in FIG. 5B, the time Tc is a period of fluctuation with respect to a requested value of a droplet speed so as to be consistent with the reference driving waveform period Tf0.

Here, the pulse 1 (P1) or the pulse 2 (P2) is selected (ON/OFF) in the reference driving waveform in FIG. 9A. Thus, two kinds of driving waveforms can be generated.

Incidentally, in the second exemplary embodiment, as an example for generating each of the driving waveforms, the reference driving waveform is outputted to one of head driving portions 22 from the control portion 14 regardless of the condition of the control procedure 1, and then, the pulse 1 or the pulse 2 is selected to be ON/OFF in the head driving portion 22 based on the condition of the control procedure 1.

(Control Procedure 3 "not Less than Range of ±5%")

A driving waveform in which the pulse 1 is set OFF and the pulse 2 is set ON in the reference driving waveform and a driving waveform in which the pulse 1 is set ON and the pulse 2 is set OFF in the reference driving waveform are generated and outputted alternately. Thus, a period Tf1 shorter by (Tc/4)×n than the droplet ejection period Tf0 and a period Tf2 longer by (Tc/4)×n than the designated droplet ejection period Tf0 are repeated (see FIG. 9B). Incidentally, Tc is the period for the residual pressure vibration in FIG. 5B so as to be consistent with Tf0. In addition, n is an odd number among integers. In the second exemplary embodiment, the relation n=5 is established (that is, ±5Tc/4).

(Control Procedure 4 "Less than Range of ±5%")

A single driving waveform in which the pulse 1 is set OFF and the pulse 2 is set ON in the reference driving waveform is generated and outputted. Thus, the droplet ejection period Tf0 is maintained (see FIG. 9C).

Figure 9D:
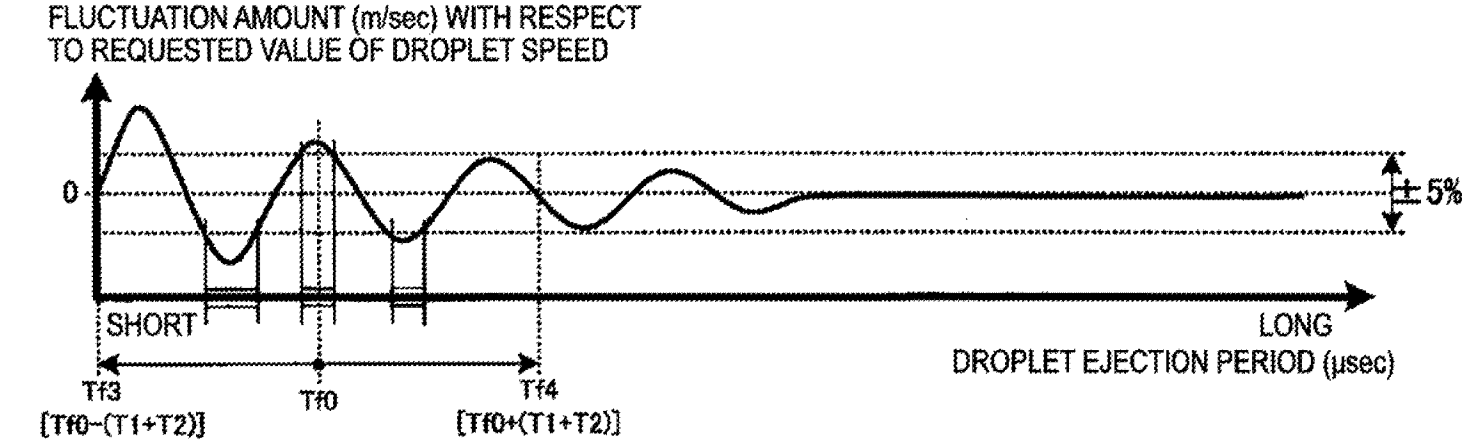

As a result, the periods are shifted by ±5Tc/4 from the designated period Tf0. Accordingly, the period for the residual pressure vibration is secured to be less than ±5% and the designated period Tf0 is secured in the entire period (see FIG. 9D).

[Third Exemplary Embodiment]

A third exemplary embodiment will be described below. Incidentally, in the third exemplary embodiment, the same portions as those in the first exemplary embodiment will be referred to by the same signs respectively and correspondingly, and description thereof will be omitted.

The third exemplary embodiment is characterized in the following point. That is, a driving waveform for continuous ejection driving is used as a modification of the driving waveform for droplet ejection so that the problem (maintenance of quality at an image formation speed out of a permissible range) described in the first exemplary embodiment can be solved even when, for example, two "large droplets" are landed.

Incidentally, the continuous ejection driving is driving by which a plurality of droplets can be landed in one and the same position (strictly the positions which can be regarded as one and the same dot though not concentric because a paper sheet P is fed). In the aforementioned modification, two "large droplets" are landed on one and the same dot.

In the third exemplary embodiment, period adjustment control is executed in the following control procedures in a control portion 14.

(Control Procedure 1) When a droplet ejection frequency (droplet ejection period) is determined in accordance with an image formation speed which is set to exceed an upper limit of a setting range, determination is made as to whether residual pressure vibration is less than ±5% or not, based on FIG. 5A or FIG. 5B.

Figure 10A:
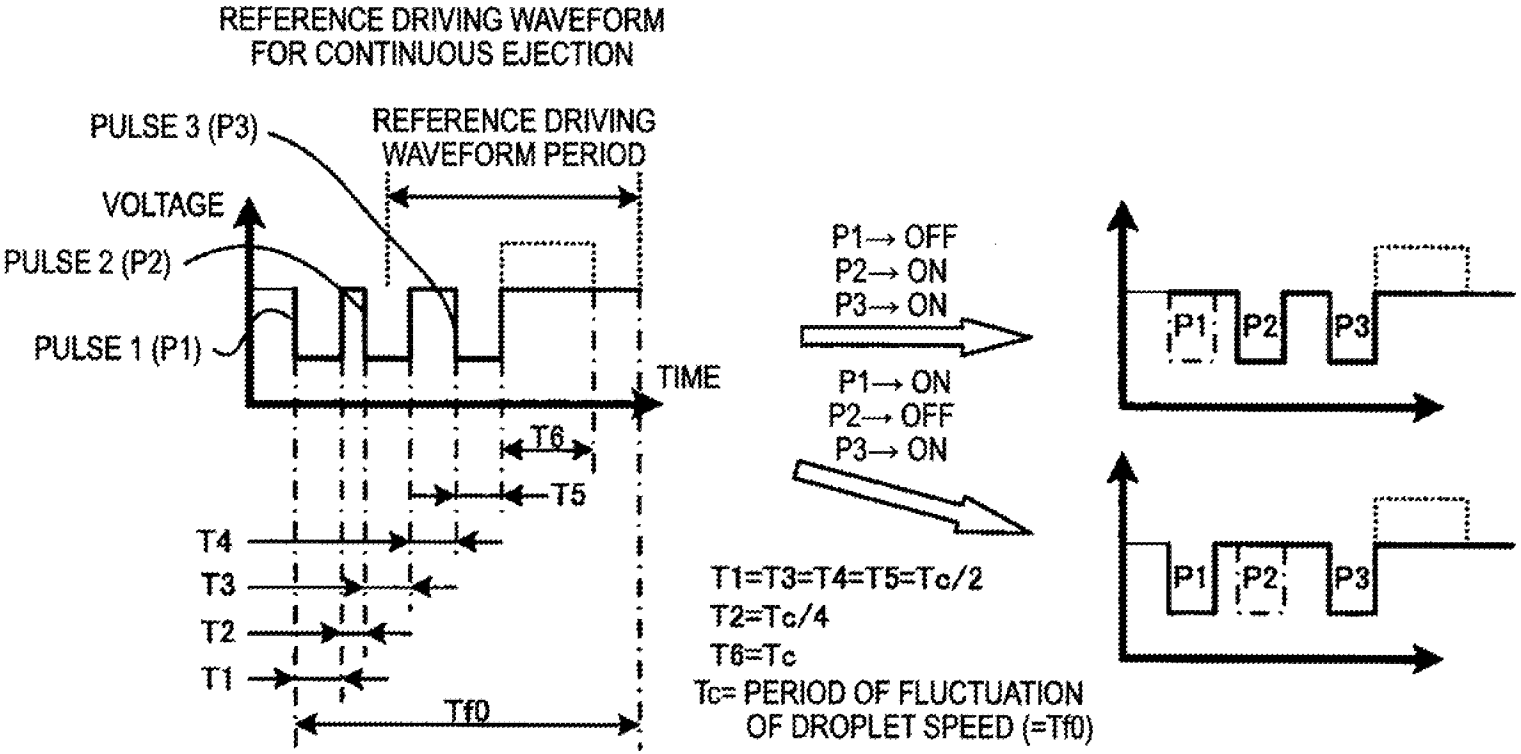
FIGS. 10A, 10B and 10C are a reference driving waveform graph and waveform graphs after selection of pulses, a timing chart of adjusted driving periods, and a timing chart of each steady driving period (continuous ejection mode), according to a third exemplary embodiment, respectively.

(Control Procedure 2) As shown in FIG. 10A, a pulse 1, a pulse 2 or a pulse 3 is suitably selected (ON/OFF) in a reference driving waveform of a reference driving waveform period (Tf0) including the pulse 1, the pulse 2 and the pulse 3. Thus, two kinds of driving waveforms are generated.

As shown in FIG. 10A, the reference driving waveform has the period Tf0 (reference driving waveform period). The reference driving waveform is a waveform in which the pulse 1 of a droplet ejection time T1 is outputted in a rising edge, the pulse 2 of a droplet ejection time T3 is then outputted after a lapse of an interval time T2, and the pulse 3 of a droplet ejection time T5 is then outputted after a lapse of an interval time T4.

Here, there is a case where a pulse signal (see a dotted line in FIG. 10A) which is set to have a width of a time T6 and is convex reversely to the pulse 1, the pulse 2 and the pulse 3 may be outputted immediately after the pulse 3.

In the reference driving waveform in FIG. 10A, the pulse signal of the aforementioned dotted line portion is intended to reduce vibration caused by droplet ejection. In other words, since the pulse signal is unnecessary in view of droplet ejection, it is designated by the dotted line in FIG. 10A.

Figure 10B:
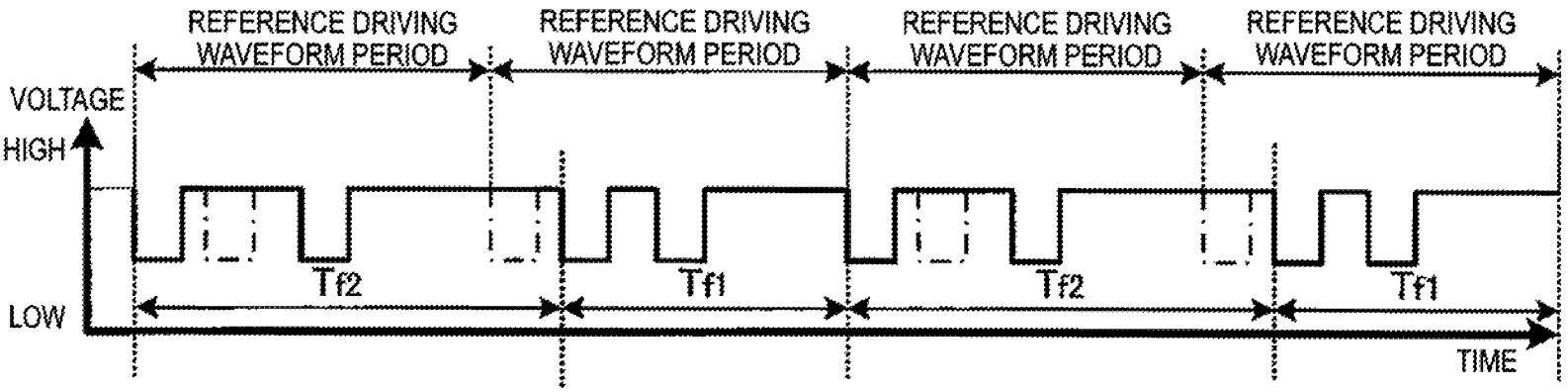
Figure 10C:
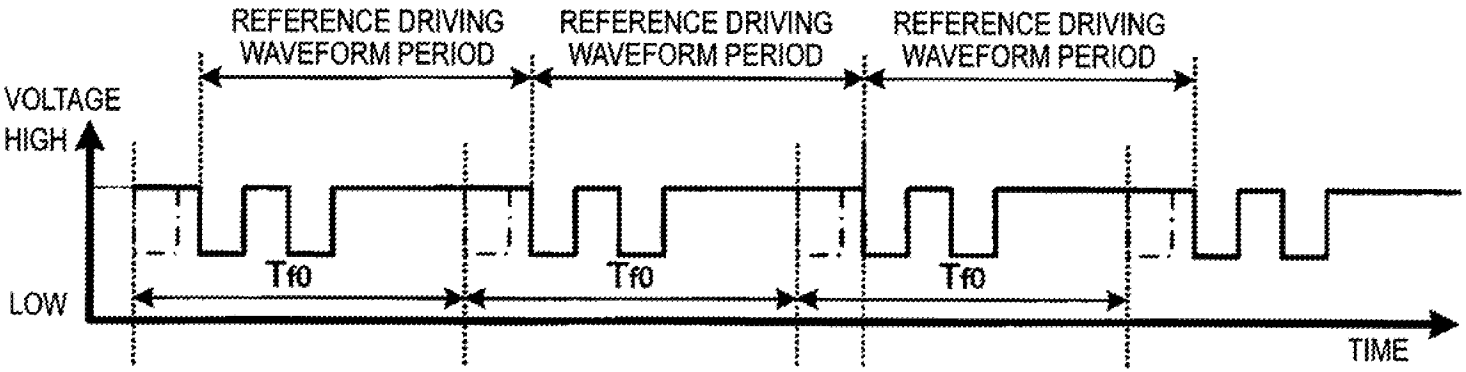

Incidentally, although the pulse of the dotted line portion for reducing the vibration is not shown in FIG. 10B and FIG. 10C, it is preferable that practical driving waveforms are used as driving waveforms including the pulses of the dotted line portions.

In the third exemplary embodiment, each of the droplet ejection times T1, T3 and T5 is equal to a time Tc/2. The interval time T2 between the pulse 1 and the pulse 2 is a time Tc/4. The interval time T4 between the pulse 2 and the pulse 3 is a time Tc/2. The time T6 of the pulse for reducing the vibration is set as a time Tc. As shown in FIG. 5B, the time Tc is a period of fluctuation with respect to a requested value of a droplet speed so as to be consistent with the reference driving waveform period Tf0.

Here, the pulse 1 (P1), the pulse 2 (P2) or the pulse 3 (P3) is selected (ON/OFF) in the reference driving waveform in FIG. 10A. Thus, two kinds of driving waveforms can be generated. In the third exemplary embodiment, a driving waveform having a combination (P2 and P3) of the pulse 2 and the pulse 3 and a driving waveform having a combination (P1 and P3) of the pulse 1 and the pulse 3 are generated for "large droplet" use.

Incidentally, in the third exemplary embodiment, as an example for generating each of the driving waveforms, the reference driving waveform is outputted to one of head driving portions 22 from the control portion 14 regardless of the condition of the control procedure 1, and then, the pulse 1, the pulse 2 or the pulse 3 is selected to be ON/OFF in the head driving portion 22 based on the condition of the control procedure 1.

(Control Procedure 3 "not Less than Range of ±5%")

A driving waveform in which the pulse 1 is set OFF, the pulse 2 is set ON and the pulse 3 is set ON in the reference driving waveform and a driving waveform in which the pulse 1 is set ON, the pulse 2 is set OFF and the pulse 3 is set ON in the reference driving waveform are generated and outputted alternately. Thus, a period Tf1 shorter by (Tc/4)×n than the droplet ejection period Tf0 and a period Tf2 longer by (Tc/4)×n than the designated droplet ejection period Tf0 are repeated (see FIG. 10B). Incidentally, Tc is the period for the residual pressure vibration in FIG. 5B so as to be consistent with Tf0. In addition, n is an odd number among integers. In the third exemplary embodiment, the relation n=7 is established (that is, ±7Tc/4).

(Control Procedure 4 "Less than Range of ±5%")

A single driving waveform in which the pulse 1 is set OFF, the pulse 2 is set ON and the pulse 3 is set ON in the reference driving waveform is generated and outputted. Thus, the droplet ejection period Tf0 is maintained (see FIG. 10C).

As a result, the periods are shifted by ±7Tc/4 from the designated period Tf0. Accordingly, the period for the residual pressure vibration is secured to be less than ±5% and the designated period Tf0 is secured in the entire period.

Incidentally, although two "large droplets" have been shown as an example of continuous ejection in the third exemplary embodiment, the invention may be applied to continuous ejection of two or more droplets including "small droplets" and "intermediate droplets".

[Fourth Exemplary Embodiment]

A fourth exemplary embodiment will be described below. Incidentally, in the fourth exemplary embodiment, the same portions as those in the third exemplary embodiment will be referred to by the same signs respectively and correspondingly, and description thereof will be omitted.

The fourth exemplary embodiment is characterized in the following point. That is, correction of a deviation in landing timing (correction of droplet speed in the first exemplary embodiment) is taken into consideration when each droplet is ejected in an adjusted ejection frequency in continuous ejection driving which has been described in the third exemplary embodiment.

Figure 11A:
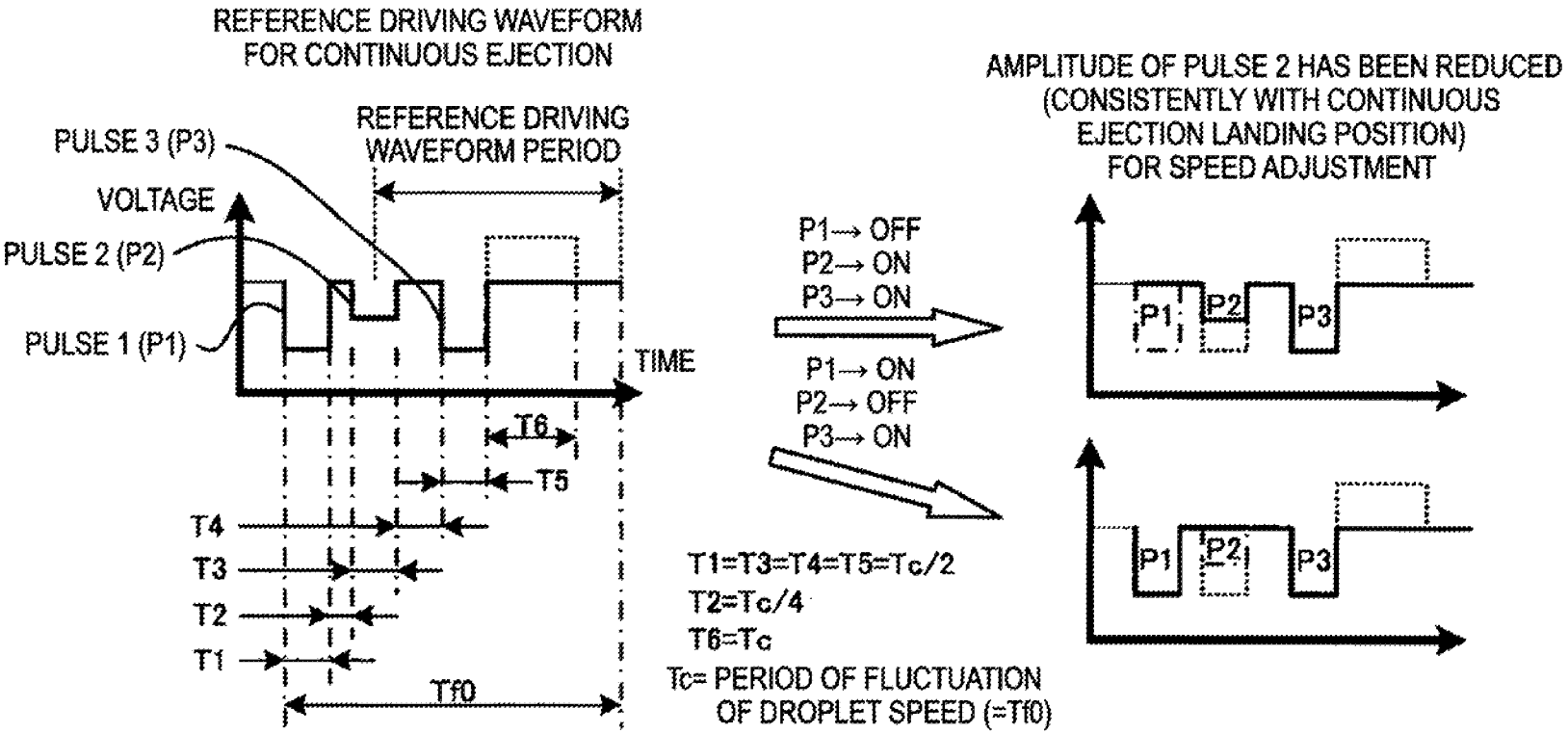
FIGS. 11A, 11B and 11C are a reference driving waveform graph and waveform graphs after selection of pulses, a timing chart of adjusted driving periods, and a timing chart of each steady driving period (continuous ejection mode+adjustment of each continuously ejected droplet landing position), according to a fourth exemplary embodiment, respectively.
Figure 11B:
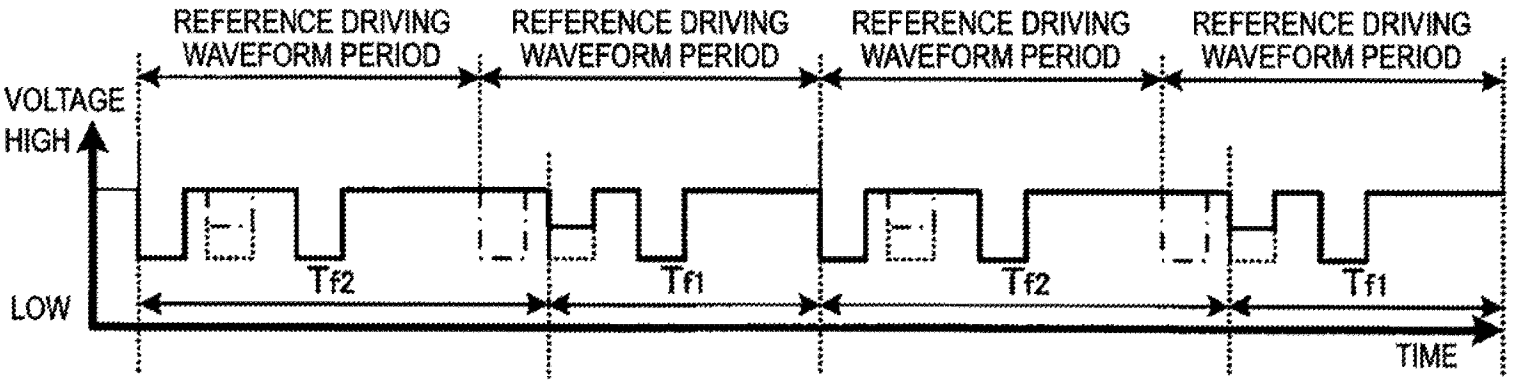

As shown in FIG. 11A, a reference driving waveform applied in the fourth exemplary embodiment has the same time widths (T1 to T6) as the reference driving waveform (see FIG. 10A) in the third exemplary embodiment.

The fourth exemplary embodiment is different from the third exemplary embodiment in the amplitude of a pulse 2 (voltage value). The pulse 2 is smaller in amplitude than a pulse 1 and a pulse 3. Accordingly, at the pulse 2, droplet speed is slower and landing timing is later correspondingly.

The pulse 2 is a pulse which is selected in an adjusted ejection period Tf1 and not selected in an adjusted ejection period Tf2.

Figure 11C:
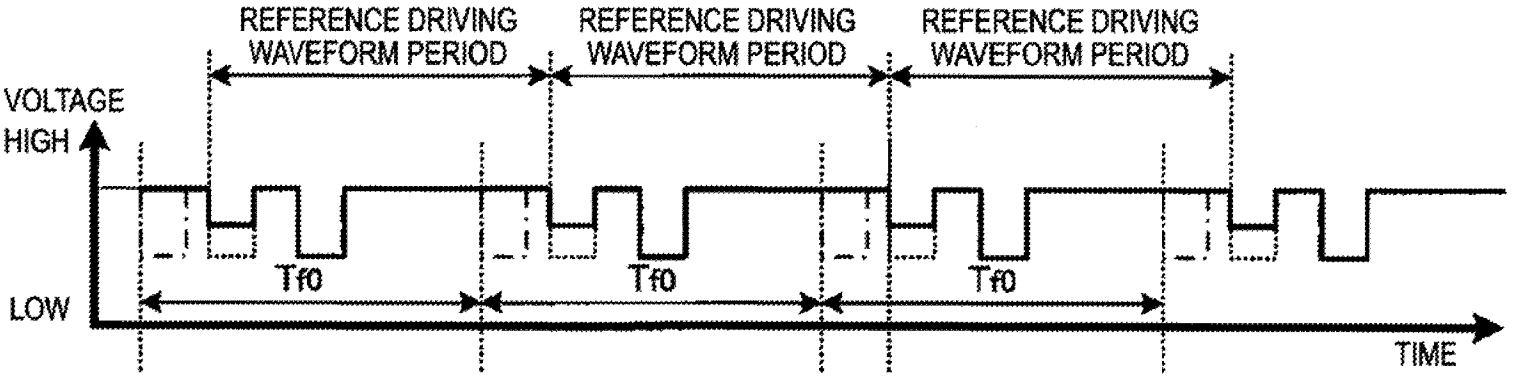

Therefore, when the ejection period does not have to be adjusted, a single driving waveform in which the pulse 1 is not selected is repeated as shown in FIG. 11C. Accordingly, droplet ejection speed is not affected but all the droplets are outputted at the same droplet speed.

On the other hand, when the ejection period has to be adjusted and the adjusted ejection period Tf1 and the adjusted ejection period Tf2 are outputted alternately, the driving waveform in which the pulse 2 is selected and the driving waveform in which the pulse 2 is not selected are outputted alternately. Accordingly, control consistent with the speed adjustment (see FIG. 8) according to the first exemplary embodiment is performed. As a result, the landing positions can be corrected.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A droplet driving control device comprising:

an output unit which outputs, at droplet ejection timing, a driving waveform for ejecting each droplet at a requested droplet election period, the waveform being a reference driving waveform comprising a plurality of pulse signals which can be set ON or OFF individually;

a determination unit which determines whether the droplet ejection period has to be changed or not;

an adjustment unit which sets each of the pulse signals of the reference driving waveform ON or OFF selectively based on a determination result of the determination unit to adjust the reference driving waveform to an adjusted driving waveform: and a droplet election control unit which ejects each droplet by use of the adjusted driving waveform adjusted by the adjustment unit; wherein the determination unit uses the magnitude of an error of droplet ejection speed as a determination criterion, the error of the droplet ejection speed being caused by a characteristic of residual vibration whose amplitude increases around a proper value of droplet speed as the droplet ejection period is shorter, and converges keeping a specific frequency; and the determination unit determines that the period of the reference driving waveform does not have to be changed when the error is less than a permissible range, and determines that the period of the reference driving waveform has to be changed when the error is not less than the permissible range.

2. The droplet driving control device according to claim 1, wherein:

when the determination unit determines that the period of the reference driving waveform does not have to be changed, the droplet ejection control unit repeats a single adjusted driving waveform adjusted by the adjustment unit to thereby control ejection of each droplet at a steady period which is the same as the period of the reference driving waveform; and when the determination unit determines that the period of the reference driving waveform has to be changed, the droplet ejection control unit repeats a plurality of adjusted driving waveforms adjusted by the adjustment unit in a predetermined order to thereby control ejection of each droplet at an adjusted period which is different from the period of the reference driving waveform.

3. The droplet driving control device according to claim 2, wherein:

the adjustment unit generates a first period Tf1 and a second period Tf2 which have different combinations of the pulse signals from each other;

the droplet ejection control unit uses and outputs one of the first period Tf1 and the second period Tf2 as a steady period when the droplet ejection period does not have to be changed; and the droplet ejection control unit alternately outputs the first period Tf1 and the second period Tf2 as an adjusted period when the droplet ejection period has to be changed.

4. The droplet driving control device according to claim 3, wherein:

each of the first period Tf1=Tf0−(Tc/4)×n and the second period Tf2=Tf0+(Tc/4)×n is set as the droplet ejection period, in which the period of the reference driving waveform is designated by Tf0, a period of the residual vibration characteristic is designated by Tc and an odd number among integers is designated by n.

5. The droplet driving control device according to claim 2, further comprising:

a correction unit which corrects the droplet speed after the droplet ejection period has been adjusted by the adjustment unit.

6. The droplet driving control device according to claim 5, wherein:

the correction unit deforms a predetermined driving waveform when each droplet reserved in a pressure chamber is ejected from a nozzle under pressure control using the driving waveform; and the correction unit deforms the driving waveform into a driving waveform decreasing pressure when the droplet ejection timing is earlier, and deforms the driving waveform into a driving waveform increasing pressure when the droplet ejection time is later.

7. The droplet driving control device according to claim 1, wherein:

the adjustment unit generates a first period Tf1 and a second period Tf2 which have different combinations of the pulse signals from each other;

the droplet ejection control unit uses and outputs one of the first period Tf1 and the second period Tf2 as a steady period when the droplet ejection period does not have to be changed; and the droplet ejection control unit alternately outputs the first period Tf1 and the second period Tf2 as an adjusted period when the droplet ejection period has to be changed.

8. The droplet driving control device according to claim 7, wherein:

each of the first period Tf1=Tf0−(Tc/4)×n and the second period Tf2=Tf0+(Tc/4)×n is set as the droplet ejection period, in which the period of the reference driving waveform is designated by Tf0, a period of the residual vibration characteristic is designated by Tc and an odd number among integers is designated by n.

9. The droplet driving control device according to claim 1, further comprising:

a correction unit which corrects the droplet speed after the droplet ejection period has been adjusted by the adjustment unit.

10. The droplet driving control device according to claim 9, wherein:

the correction unit deforms a predetermined driving waveform when each droplet reserved in a pressure chamber is ejected from a nozzle under pressure control using the driving waveform; and the correction unit deforms the driving waveform into a driving waveform decreasing pressure when the droplet ejection timing is earlier, and deforms the driving waveform into a driving waveform increasing pressure when the droplet ejection time is later.

11. A droplet driving control device comprising:

an output unit which outputs, at droplet ejection timing, a driving waveform for ejecting each droplet at a requested droplet election period, the waveform being a reference driving waveform comprising a plurality of pulse signals which can be set ON or OFF individually;

a determination unit which determines whether the droplet ejection period has to be changed or not;

an adjustment unit which sets each of the pulse signals of the reference driving waveform ON or OFF selectively based on a determination result of the determination unit to adjust the reference driving waveform to an adjusted driving waveform; and a droplet ejection control unit which ejects each droplet by use of the adjusted driving waveform adjusted by the adjustment unit; wherein when the determination unit determines that the period of the reference driving waveform does not have to be changed, the droplet ejection control unit repeats a single adjusted driving waveform adjusted by the adjustment unit to thereby control ejection of each droplet at a steady period which is the same as the period of the reference driving waveform; and when the determination unit determines that the period of the reference driving waveform has to be changed, the droplet ejection control unit repeats a plurality of adjusted driving waveforms adjusted by the adjustment unit in a predetermined order to thereby control ejection of each droplet at an adjusted period which is different from the period of the reference driving waveform.

12. The droplet driving control device according to claim 11, wherein:

the adjustment unit generates a first period Tf1, and a second period Tf2 which have different combinations of the pulse signals from each other;

the droplet ejection control unit uses and outputs one of the first period Tf1 and the second period Tf2 as a steady period when the droplet ejection period does not have to be changed; and the droplet ejection control unit alternately outputs the first period Tf1 and the second period Tf2 as an adjusted period when the droplet ejection period has to be changed.

13. The droplet driving control device according to claim 12, wherein:

each of the first period Tf1=Tf0−(Tc/4)×n and the second period Tf2=Tf0+(Tc/4)×n is set as the droplet ejection period, in which the period of the reference driving waveform is designated by Tf0, a period of the residual vibration characteristic is designated by Tc and an odd number among integers is designated by n.

14. The droplet driving control device according to claim 11, further comprising:

a correction unit which corrects a droplet speed after the droplet ejection period has been adjusted by the adjustment unit.

15. The droplet driving control device according to claim 14, wherein:

the correction unit deforms a predetermined driving waveform when each droplet reserved in a pressure chamber is ejected from a nozzle under pressure control using the driving waveform; and the correction unit deforms the driving waveform into a driving waveform decreasing pressure when the droplet ejection timing is earlier, and deforms the driving waveform into a driving waveform increasing pressure when the droplet ejection time is later.

16. An image forming apparatus, comprising:

a droplet driving control device including:

an output unit which outputs, at droplet ejection timing, a driving waveform for ejecting each droplet at a requested droplet ejection period, the waveform being a reference driving waveform comprising a plurality of pulse signals which can be set ON or OFF individually;

a determination unit which determines whether the droplet election period has to be changed or not;

an adjustment unit which sets each of the pulse signals of the reference driving waveform ON or OFF selectively based on a determination result of the determination unit to adjust the reference driving waveform to an adjusted driving waveform; and a droplet ejection control unit which elects each droplet by use of the adjusted driving waveform adjusted by the adjustment unit; wherein:

the image forming apparatus can select one from a normal specification mode and a specific specification mode as a droplet ejection period, an image being formed in a setting range in which at least droplet speed does not fluctuate in the normal specification mode, an image being formed in a specific period which exceeds the setting range in the specific specification mode.

* * * * *